US010286666B2

(12) United States Patent
Ishikawa et al.

(10) Patent No.: US 10,286,666 B2
(45) Date of Patent: May 14, 2019

(54) INK DISCHARGE DEVICE AND INK DISCHARGE METHOD

(71) Applicants: Masahiko Ishikawa, Shizuoka (JP); Hiroshi Gotou, Kanagawa (JP); Takahiro Yoshida, Ibaraki (JP); Yukio Otome, Ibaraki (JP)

(72) Inventors: Masahiko Ishikawa, Shizuoka (JP); Hiroshi Gotou, Kanagawa (JP); Takahiro Yoshida, Ibaraki (JP); Yukio Otome, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/794,068

(22) Filed: Oct. 26, 2017

(65) Prior Publication Data

US 2018/0126731 A1 May 10, 2018

(30) Foreign Application Priority Data

Nov. 8, 2016 (JP) ..... 2016-218346

(51) Int. Cl.
*B41J 2/14* (2006.01)

(52) U.S. Cl.
CPC ..... *B41J 2/1433* (2013.01); *B41J 2/14233* (2013.01); *B41J 2/14274* (2013.01); *B41J 2002/14403* (2013.01); *B41J 2202/12* (2013.01)

(58) Field of Classification Search
CPC combination set(s) only.
See application file for complete search history.

(56) References Cited

U.S. PATENT DOCUMENTS

2014/0002539 A1 1/2014 Goto et al.
2015/0035896 A1* 2/2015 Gotou ..... B41J 11/0015 347/20

(Continued)

FOREIGN PATENT DOCUMENTS

JP 2000-053897 2/2000
JP 2001-139849 5/2001

(Continued)

OTHER PUBLICATIONS

Robert F. Fedors , "A method for estimating both the solubility parameters and molar volumes of liquids" Polymer Engineering and Science, 1974, vol. 14, No. 2, 147-154.

(Continued)

*Primary Examiner* — Bradley W Thies
(74) *Attorney, Agent, or Firm* — Oblon, McClelland, Maier & Neustadt, L.L.P.

(57) ABSTRACT

An ink discharge device is provided including an ink, an ink discharge head, and a circulator. The ink discharge head includes a nozzle, an individual liquid chamber communicated with the nozzle, a flow-in channel, and a flow-out channel. The circulator circulates the ink by letting the ink flow into the individual liquid chamber via the flow-in channel and flow out from the individual liquid chamber via the flow-out channel. A flow rate of the circulated ink is 0.10 to 1.50 times a maximum dischargeable rate of the ink discharge head. A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation:

$$10.0(\%) \leq [(A-B)/(A+B)] \times 100 \leq 19.0(\%).$$

10 Claims, 10 Drawing Sheets

(56) References Cited

U.S. PATENT DOCUMENTS

| | | | |
|---|---|---|---|
| 2016/0185113 | A1 | 6/2016 | Yoshida et al. |
| 2016/0333208 | A1 | 11/2016 | Gotou et al. |

FOREIGN PATENT DOCUMENTS

| | | | |
|---|---|---|---|
| JP | 2008-508381 | | 3/2008 |
| JP | 2008-516019 | | 5/2008 |
| JP | 2009-532524 | | 9/2009 |
| JP | 2012-207202 | | 10/2012 |
| JP | 2014-094998 | | 5/2014 |
| JP | 2016-124191 | | 7/2016 |
| WO | WO 2006/010666 | A1 | 2/2006 |
| WO | WO 2006/037380 | A1 | 4/2006 |
| WO | WO 2007/127004 | A1 | 11/2007 |

OTHER PUBLICATIONS

Imoto Minoru, "Basic Theory of Gluing, Macromolecule Publication Meeting" pp. 89-103.

* cited by examiner

INK DISCHARGE DEVICE AND INK DISCHARGE METHOD

CROSS-REFERENCE TO RELATED APPLICATIONS

This patent application is based on and claims priority pursuant to 35 U.S.C. § 119(a) to Japanese Patent Application No. 2016-218346, filed on Nov. 8, 2016, in the Japan Patent Office, the entire disclosure of which is hereby incorporated by reference herein.

BACKGROUND

Technical Field

The present disclosure relates to an ink discharge device and an ink discharge method.

Description of the Related Art

Inkjet image forming methods are spreading rapidly these days thanks to their simple process in recording color images and low running cost.

Water-based pigment inks in which fine particles of pigments are dispersed in water are attracting attention as inks for use in the inkjet image forming methods. Since the pigments in water-based pigment inks have a similar composition to conventional colorants generally used for commercial printing inks, it is expected that the texture of printed matter produced by water-based pigment inks can be brought close to that of commercially printed matter. However, water-based pigment inks have a drawback that, when recorded on coated paper for commercial printing or publication printing, beading phenomenon occurs because permeation of the pigment into the coated paper is too slow.

SUMMARY

In accordance with some embodiments of the present invention, an ink discharge device is provided. The ink discharge device includes an ink, an ink discharge head, and a circulator. The ink comprises a colorant, an organic solvent, and water. The ink discharge head includes a nozzle configured to discharge the ink, an individual liquid chamber communicated with the nozzle, a flow-in channel configured to let the ink flow into the individual liquid chamber, and a flow-out channel configured to let the ink flow out from the individual liquid chamber. The circulator is configured to circulate the ink by letting the ink flow into the individual liquid chamber via the flow-in channel and flow out from the individual liquid chamber via the flow-out channel. A flow rate of the circulated ink is 0.10 to 1.50 times a maximum dischargeable rate of the ink discharge head. A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation:

$$10.0(\%) \leq [(A-B)/(A+B)] \times 100 \leq 19.0(\%).$$

In accordance with some embodiments of the present invention, an ink discharge method is provided. The method includes the process of discharging an ink from a nozzle disposed in an ink discharge head. The process of discharging further includes the processes of: letting an ink flow into an individual liquid chamber, communicated with the nozzle, via a flow-in channel; letting the ink flow out from the individual liquid chamber via a flow-out channel; and circulating the ink by letting the ink flow into the individual liquid chamber via the flow-in channel and flow out from the individual liquid chamber via the flow-out channel. The ink comprises a colorant, an organic solvent, and water. A flow rate of the circulated ink is 0.10 to 1.50 times a maximum dischargeable rate of the ink discharge head. A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation:

$$10.0(\%) \leq [(A-B)/(A+B)] \times 100 \leq 19.0(\%).$$

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
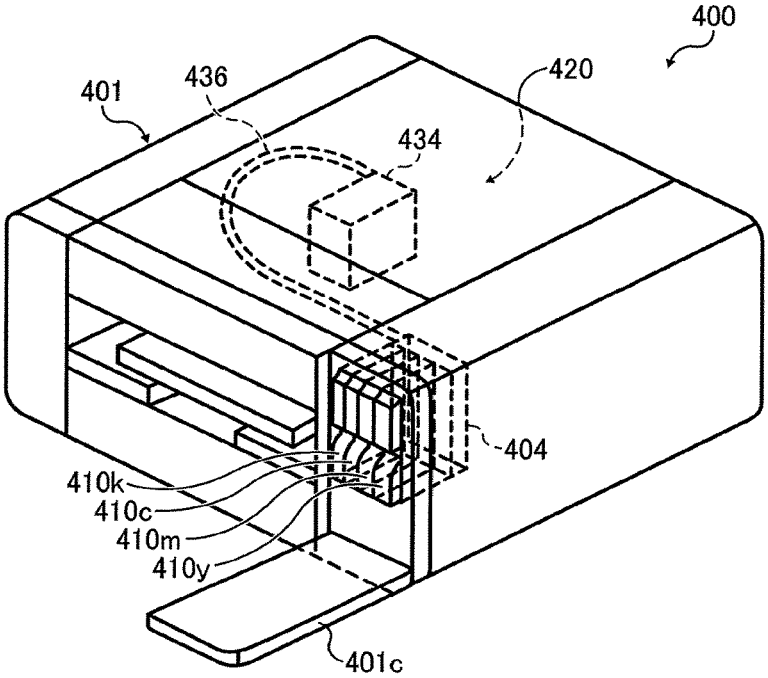
FIG. 1 is a schematic perspective view of a recording device in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an ink discharge device is provided that is capable of: (1) exhibiting excellent beading resistance on not only plain paper but also general-purpose printing paper; (2) reliably producing high-quality images having high image density for an extended period of time; (3) exhibiting excellent ink discharge stability; and (4) preventing the occurrence of meniscus outflow.

Ink Discharge Device and Ink Discharge Method

In accordance with some embodiments of the present invention, an ink discharge device is provided. The ink discharge device includes an ink, an ink discharge head, and a circulator. The ink comprises a colorant, an organic solvent, and water. The ink discharge head includes a nozzle configured to discharge the ink, an individual liquid chamber communicated with the nozzle, a flow-in channel configured to let the ink flow into the individual liquid chamber, and a flow-out channel configured to let the ink flow out from the individual liquid chamber. The circulator is configured to circulate the ink by letting the ink flow into the individual liquid chamber via the flow-in channel and flow out from the individual liquid chamber via the flow-out channel. A flow rate of the circulated ink is 0.10 to 1.50 times a maximum dischargeable rate of the ink discharge head. A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation: $10.0(\%) \leq [(A-B)/(A+B)] \times 100 \leq 19.0$ (%). The ink discharge device may further optionally include other devices, as necessary.

In accordance with some embodiments of the present invention, an ink discharge method is provided. The method includes the step of discharging an ink from a nozzle disposed in an ink discharge head. The step of discharging further includes the steps of: letting an ink flow into an individual liquid chamber via a flow-in channel, where the individual liquid chamber being communicated with the nozzle; letting the ink flow out from the individual liquid chamber via a flow-out channel; and circulating the ink by letting the ink flow into the individual liquid chamber via the flow-in channel and flow out from the individual liquid chamber via the flow-out channel. The ink comprises a colorant, an organic solvent, and water. A flow rate of the circulated ink is 0.10 to 1.50 times a maximum dischargeable rate of the ink discharge head. A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation: $10.0(\%) \leq [(A-B)/(A+B)] \times 100 \leq 19.0$ (%). The ink discharge method may further optionally include other steps, as necessary.

The above ink discharge device and ink discharge method are achieved based on the finding that, because conventional inks have not optimized the relation between a dynamic surface tension (measured by a maximum bubble pressure method at a surface lifetime of 15 msec) and a static surface tension, the ink easily wets an ink-repellent film on a nozzle plate of an ink head and adheres to the nozzle plate, thereby causing deterioration of ink discharge stability.

The above ink discharge device and ink discharge method are also achieved based on the other finding that ink discharge devices having a conventional circulation-type ink discharge head have difficulty in circulating ink in the vicinity of the nozzles, thereby causing drying of meniscus, deterioration of ink discharge stability, and the occurrence of meniscus outflow and bubble entrainment.

Accordingly, the ink discharge device in accordance with some embodiments of the present invention includes an ink, an ink discharge head, and a circulator. The ink comprises a colorant, an organic solvent, and water. The ink discharge head includes a nozzle configured to discharge the ink, an individual liquid chamber communicated with the nozzle, a flow-in channel configured to let the ink flow into an individual liquid chamber, and a flow-out channel configured to let the ink flow out from the individual liquid chamber. The circulator is configured to circulate the ink by letting the ink flow into the individual liquid chamber via the flow-in channel and flow out from the individual liquid chamber via the flow-out channel. A flow rate of the circulated ink is 0.10 to 1.50 times, preferably 0.20 to 1.20 times, a maximum dischargeable rate of the ink discharge head.

The flow rate of the circulated ink may be represented by a unit of mL/min. When the flow rate is stated to be 1.0 times, it means that the ratio of the flow rate to the maximum dischargeable rate of the ink discharge head is 1.0.

The flow rate of the ink can be adjusted by adjusting the liquid feed amount of a liquid feed pump.

The flow rate of the ink can be measured by a flowmeter.

When the flow rate is 0.10 times or more, it is easy to circulate the ink in the vicinity of the nozzle without drying the meniscus. There is no delay in landing position of the firstly-ejected dot, and bubbles having entered into the liquid chamber can be discharged. Thus, nozzle missing is prevented in continuous ejection. When the flow rate is 1.50 times or less, the meniscus can be maintained and the occurrence of meniscus outflow and bubble entrainment can be prevented.

It is difficult to achieve the above-specified flow rate by merely using the above ink discharge head. When the ink discharge head is combined with the above ink in which the balance between a dynamic surface tension A and a static surface tension B has been optimized, because the ink is unlikely to wet a water-repellent film on the nozzle plate of the ink discharge head, the meniscus can be maintained even when the flow rate is increased. Even when the flow rate gets larger than a conventional flow rate, the meniscus can be maintained without being dried, thereby preventing deterioration of ink discharge stability and the occurrence of meniscus outflow and bubble entrainment while reliably providing high-quality image for an extended period of time.

Ink

The ink comprises a colorant, an organic solvent, and water. Preferably, the ink further comprises a polyethylene wax and a surfactant. The ink may further optionally comprise other components.

A dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the relation $10.0(\%) \leq [(A-B)/(A+B)] \times 100 \leq 19.0(\%)$. By this requirement, the ink securely exhibits sufficient wettability to recording media. In particular, the ink can rapidly permeate coated paper (e.g., general-purpose printing paper) that is generally poor in ink absorptivity. Thus, as the ink has landed on the paper sheet, pigment (colorant) aggregation rapidly occurs to thicken the ink, while the ink is being dried, thereby suppressing the occurrence of beading.

The dynamic surface tension A of the ink at 25° C. is 34.0 mN/m or less, preferably 30.0 mN/m or less, more preferably from 25.0 to 30.0 mN/m, when measured by a maximum bubble pressure method at a surface lifetime of 15 msec.

When the dynamic surface tension A is 34.0 mN/m or less, wettability and permeability of the ink to general-purpose printing paper are improved and the occurrence of beading and color bleeding is more effectively suppressed. In addition, color developing property on plain paper is improved while the occurrence of white spots is suppressed.

The dynamic surface tension A can be measured by a maximum bubble pressure method at a surface lifetime of 15 msec using an instrument SITA DynoTester (available from SITA Messtechnik GmbH) at 25° C.

The dynamic surface tension A and a static surface tension B of the ink at 25° C. satisfy the relation $10.0(\%) \leq [(A-B)/(A+B)] \times 100 \leq 19.0(\%)$, preferably $12.0(\%) \leq [(A-B)/(A+B)] \times 100 \leq 17.0(\%)$.

When the relation $10.0(\%) \leq [(A-B)/(A+B)] \times 100 \leq 19.0(\%)$ is satisfied, the balance between the dynamic surface tension A and the static surface tension B of the ink is optimized and the ink is unlikely to wet a water-repellent film on the nozzle plate of the ink discharge head. Thus, the ink reliably provides discharge stability without causing nozzle missing in continuous discharge.

Preferably, the static surface tension B of the ink at 25° C. is from 20.0 to 30.0 mN/m.

When the static surface tension B is from 20.0 to 30.0 mN/m, ink permeability is improved, the occurrence of cockling and curing is more effectively suppressed, and the ink exhibits good permeability and drying property when printed on plain paper.

The static surface tension B can be measured by an automatic surface tensiometer (CBVP-Z available from Kyowa Interface Science Co., Ltd.) at 25° C.

Organic Solvent

There is no specific limitation on the type of the organic solvent. For example, water-soluble organic solvents are usable. Preferably, the organic solvent comprises at least one organic solvent having a solubility parameter not less than 8.96 and less than 11.8. By including the organic solvent having a solubility parameter not less than 8.96 and less than 11.8, the occurrence of beading can be suppressed on general-purpose printing paper.

Here, the solubility parameter ("SP") refers to a numerical value indicating solvency behavior of one material to another material. The solubility parameter is represented by the square root of the cohesive energy density (CED) that indicates an intermolecular attracting force. The cohesive energy density is the amount of energy needed for vaporizing 1 mL of a material.

The solubility parameter is defined by the regular solution theory introduced by Hildebrand. The solubility parameter indicates the solubility of a two-component system solution.

The solubility parameter can be calculated in various ways. In the present disclosure, the solubility parameter is calculated from the following formula (B) based on the Fedors' method widely used.

$$\text{Solubility Parameter (SP)} = (\text{CED})^{1/2} = (E/V)^{1/2} \qquad \text{Formula (B)}$$

In the formula (B), E represents molecular cohesive energy (cal/mol) and V represents molecular volume ($cm^3$/mol). E and V are represented by the following formulae (C) and (D), respectively, where Δei and Δvi respectively represent vaporization energy and molar volume of an atomic group.

$$E = \Sigma \Delta ei \qquad \text{Formula (C)}$$

$$V = \Sigma \Delta vi \qquad \text{Formula (D)}$$

Detail of the above calculation method and data of vaporization energy Δei and molar volume Δvi are available in a publication "Imoto, Minoru. *Basic Theory of Gluing,* Macromolecule Publication Meeting, pp. 89-103".

Data unavailable in this publication, such as data for —$CF_3$ group, may be obtained from a document "Fedors, Robert F. *Polymer Engineering and Science,* 1974, Vol. 14, No. 2, 147-154".

Preferably, the organic solvent having a solubility parameter not less than 8.96 and less than 11.8 comprises at least one of amide compounds represented by the following formula (I) and oxetane compounds represented by the following formula (II).

Formula (I)

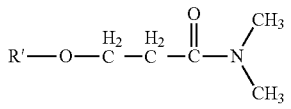

In the formula (I), R' represents an alkyl group having 4 to 6 carbon atoms.

Formula (II)

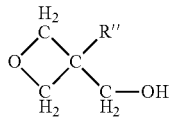

In the formula (II), R" represents an alkyl group having 1 to 2 carbon atoms.

Specific examples of the amide compounds represented by the formula (I) and the oxetane compounds represented by the formula (II) are listed below.

Formula (1)

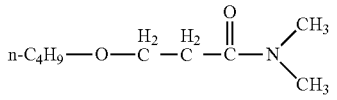

SP = 9.03

-continued

Formula (2)

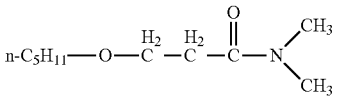

SP = 9.00

Formula (3)

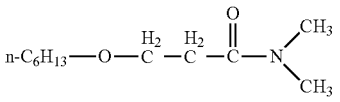

SP = 8.96

Formula (4)

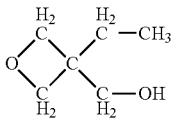

SP = 11.3

Formula (5)

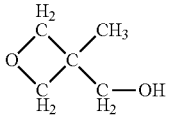

SP = 11.79

Preferably, the organic solvent further includes a polyol having a solubility parameter of from 11.8 to 14.0 and/or a penetrant having a solubility parameter not less than 8.96 and less than 11.8, other than the amide compound represented by the formula (I) and/or the oxetane compound represented by the formula (II).

Specific examples of the polyol having a solubility parameter of from 11.8 to 14.0 include, but are not limited to, 3-methyl-1,3-butanediol (SP=12.05), 1,2-butanediol (SP=12.8), 1,3-butanediol (SP=12.75), 1,4-butanediol (SP=12.95), 2,3-butanediol (SP=12.55), 1,2-propanediol (SP=13.5), 1,3-propanediol (SP=13.72), 1,2-hexanediol (SP=11.8), 1,6-hexanediol (SP=11.95), 3-methyl-1,5-pentanediol (SP=11.8), triethylene glycol (SP=12.12), and diethylene glycol (SP=13.02). Each of these compounds can be used alone or in combination with others.

Among these compounds, 3-methyl-1,3-butanediol (SP=12.05), 1,2-butanediol (SP-12.8), 1,3-butanediol (SP=12.75), 1,4-butanediol (SP=12.95), 2,3-butanediol (SP=12.55), 1,2-propanediol (SP=13.5), and 1,3-propanediol (SP=13.72) are preferable, and 1,2-butanediol (SP=12.8) and 1,2-propanediol (SP=13.5) are more preferable.

Preferably, a total content rate of the polyol having a solubility parameter of from 11.8 to 14.0 and the amide compound represented by the formula (I) and/or oxetane compound represented by the formula (II) in the ink is from 30% to 60% by mass.

When the content rate is 30% by mass or more, the occurrence of beading and color bleeding between colors may be suppressed on general-purpose printing paper. When the content rate is 60% by mass or less, image quality is good, ink viscosity is appropriate, and discharge stability is good.

Specific examples of the penetrant having a solubility parameter not less than 8.96 and less than 11.8 include, but are not limited to, polyol or glycol ether compounds having 8 to 11 carbon atoms.

Among such polyol or glycol ether compounds, 1,3-diol compounds represented by the following formula (VII) is preferable, and 2-ethyl-1,3-hexanediol (SP=10.6) and 2,2,4-trimethyl-1,3-pentanediol (SP=10.8) are more preferable.

Formula (VII)

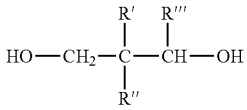

In the formula (VII), R' represents methyl group or ethyl group, R" represents hydrogen atom or methyl group, and R'" represents ethyl group or propyl group.

Specific examples of the polyol compound further include, but are not limited to, 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, and 5-hexene-1,2-diol.

Preferably, the content rate of the penetrant in the ink is from 0.5% to 4% by mass, more preferably from 1% to 3% by mass. When the content rate is 0.5% by mass or more, ink permeability is well exhibited and image quality is improved. When the content rate is 4% by mass or less, the initial viscosity of the ink becomes appropriate.

Preferably, the content rate of the organic solvent having a solubility parameter not less than 8.96 and less than 11.8 is 20% by mass or more, more preferably from 20% to 60% by mass.

When the content rate is 20% by mass or more, the occurrence of beading and color bleeding between colors is more effectively suppressed on general-purpose printing paper. When the content rate is 60% by mass or less, image quality is improved, ink viscosity becomes appropriate, and discharge stability is improved.

Preferably, the organic solvent includes no polyol having an equilibrium moisture content of 30% or more at a temperature of 23° C. and a relative humidity of 80%.

The equilibrium moisture content refers to the equilibrated amount of moisture determined from the following formula, when 1 g of a sample weighed in a petri dish is stored in a desiccator maintained at a temperature of 23° C.±1° C. and a relative humidity of 80%±3% by a saturated aqueous solution of potassium chloride and sodium chloride.

Equilibrium Moisture Content (%)=[(Amount of Moisture Absorbed in Organic Solvent)/{(Amount of Organic Solvent)+(Amount of Moisture Absorbed in Organic Solvent)}]×100

If the organic solvent includes a polyol having an equilibrium moisture content of 30% or more at a temperature of 23° C. and a relative humidity of 80%, permeation of the ink into coated paper (e.g., general-purpose printing paper) that is generally poor in ink absorptivity will be delayed and the ink landed on the paper will be dried slowly, resulting in the occurrence of beading.

Examples of the polyol having an equilibrium moisture content of 30% or more at a temperature of 23° C. and a relative humidity of 80% are disclosed in, for example, JP-2012-207202-A and JP-2014-94998-A.

Specific examples of the polyol having an equilibrium moisture content of 30% or more at a temperature of 23° C. and a relative humidity of 80% include, but are not limited to, 1,2,3-butanetriol (equilibrium moisture content=38%), 1,2,4-butanetriol (equilibrium moisture content=41%), glycerin (equilibrium moisture content=49%, SP=16.38), diglycerin (equilibrium moisture content=38%), triethylene glycol (equilibrium moisture content=39%, SP=15.4), tetraethylene glycol (equilibrium moisture content=37%), diethylene glycol (equilibrium moisture content=43%), and 1,3-butanediol (equilibrium moisture content=35%).

Colorant

Preferably, the colorant comprises a water-dispersible pigment. The colorant may further comprise a dye in combination with the pigment for the purpose of adjusting color tone so long as fade resistance is not degraded.

Examples of the water-dispersible pigments include organic pigments and inorganic pigments.

Specific examples of the inorganic pigments include, but are not limited to, titanium oxide, iron oxide, calcium carbonate, barium sulfate, aluminum hydroxide, barium yellow, cadmium red, chrome yellow, and carbon black. Among these inorganic pigments, carbon black is preferable.

The carbon black (Pigment Black 7) may be produced by a known method, such as a contact method, furnace method, and thermal method. Specific examples of the carbon black include, but are not limited to, channel black, furnace black, gas black, and lamp black.

Specific examples of commercially-available products of the carbon black include, but are not limited to: BLACK PEARLS (trademark) series 2000, 1400, 1300, 1100, 1000, 900, 880, 800, 700, 570, and L, ELFTEX (trademark) 8, MONARCH (trademark) series 1400, 1300, 1100, 1000, 900, 880, 800, and 700, MOGUL (trademark) L, REGAL (trademark) series 330, 400, and 660, and VULCAN (trademark) P, available from Cabot Corporation; and SENSIJET series BLACK SDP100, BLACK SDP1000, and BLACK SDP2000, available from Sensient Technologies Corporation. Each of these materials can be used alone or in combination with others.

Specific examples of the organic pigments include, but are not limited to, azo pigments, polycyclic pigments, dye chelates, nitro pigments, nitroso pigments, and aniline black. Among these organic pigments, azo pigments and polycyclic pigments are preferable.

Specific examples of the azo pigments include, but are not limited to, azo lakes, insoluble azo pigments, condensed azo pigments, and chelate azo pigments. Specific examples of the polycyclic pigments include, but are not limited to, phthalocyanine pigments, perylene pigments, perinone pigments, anthraquinone pigments, quinacridone pigments, dioxazine pigments, indigo pigments, thioindigo pigments, isoindolinone pigments, and quinophthalone pigments. Specific examples of the dye chelates include, but are not limited to, basic dye chelates and acid dye chelates.

Specific examples of the organic pigments further include, but are not limited to: C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 128, 139, 150, 151, 155, 153, 180, 183, 185, and 213; C.I. Pigment Orange 5, 13, 16, 17, 36, 43, and 51; C.I. Pigment Red 1, 2, 3, 5, 17, 22, 23, 31, 38, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (red iron oxide), 104, 105, 106, 108 (cadmium red), 112, 114, 122 (quinacridone magenta), 123, 146, 149, 166, 168, 170, 172, 177, 178, 179, 185, 190, 193, 209, and 219; C.I. Pigment Violet 1 (rhodamine lake), 3, 5:1, 16, 19, 23, and 38; C.I. Pigment Blue 1, 2, 15 (phthalocyanine blue), 15:1, 15:2, 15:3 (phthalocyanine blue), 16, 17:1, 56, 60, and 63; and C.I. Pigment Green 1, 4, 7, 8, 10, 17, 18, and 36. Each of these pigments can be used alone or in combination with others.

Preferably, the pigment has a specific surface area of from 10 to 1,500 $m^2/g$, more preferably from 20 to 600 $m^2/g$, and most preferably from 50 to 300 $m^2/g$.

In a case in which the specific surface area of the pigment is out of the above range, a typical size reduction or pulverization treatment, such as ball mill pulverization, jet mill pulverization, and ultrasonic treatment, may be performed to reduce the particle diameter of the pigment.

Preferably, the pigment has a 50% cumulative volume-based particle diameter ($D_{50}$) of from 10 to 200 nm in the ink.

Examples of the water-dispersible pigment include, but are not limited to, pigments (1) dispersible with surfactants, pigments (2) dispersible with resins, resin-coated pigments (3) the surfaces of which are coated with a resin, and self-dispersible pigments (4) having hydrophilic group on their surfaces.

Among these, the resin-coated pigments (3) and the self-dispersible pigments (4) having hydrophilic group on their surfaces are preferable, because temporal storage stability is high and viscosity increase can be suppressed at the time of moisture evaporation.

Preferably, the self-dispersible pigments (4) having hydrophilic group are anionically charged. In this case, the pigment preferably has an anionic functional group such as —COOM, —$SO_3M$, —$PO_3HM$, —$PO_3M_2$, —$CONM_2$, —$SO_3NM_2$, —NH—$C_6H_4$—COOM, —NH—$C_6H_4$—$SO_3M$, —NH—$C_6H_4$—$PO_3HM$, —NH—$C_6H_4$—$PO_3M_2$, —NH—$C_6H_4$—$CONM_2$, and —NH—$C_6H_4$—$SO_3NM_2$, where M represents a counter ion such as an alkali metal ion and quaternary ammonium ion. Quaternary ammonium ions are more preferred as M.

Specific examples of the quaternary ammonium ion include, but are not limited to, tetramethyl ammonium ion, tetraethyl ammonium ion, tetrapropyl ammonium ion, tetrabutylammonium ion, tetrapentylammonium ion, benzyltrimethylammonium ion, benzyltriethylammonium ion, and tetrahexylammonium ion. Among these, tetrabutylammonium ion is preferable.

Such a self-dispersible pigment having both a hydrophilic functional group and a quaternary ammonium ion has affinity for both water-rich inks and organic-solvent-rich inks, from which moisture has been evaporated, thus stably maintaining pigment dispersion in the ink.

In particular, a self-dispersible pigment modified with at least one of a geminal bisphosphonic acid group and a geminal bisphosphonate group is well re-dispersible in the ink even after the ink has been once dried. Therefore, even when a printing operation is suspended for a long period of time and moisture in the ink has been evaporated in the vicinity of the inkjet head nozzles, the printing operation can be restarted after a simple cleaning operation without the nozzles being clogged with the ink. In addition, such an ink has high temporal storage stability and is suppressed from increasing viscosity even when moisture is evaporated therefrom. Thus, such an ink provides excellent adhesion to a head maintenance device and discharge reliability.

Examples of the phosphoric acid group and phosphonate group include the following groups represented by the formula (i) to (iv).

Formula (i)

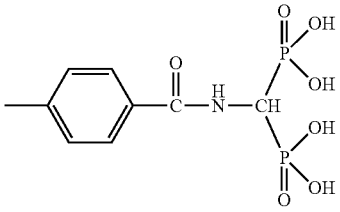

Formula (ii)

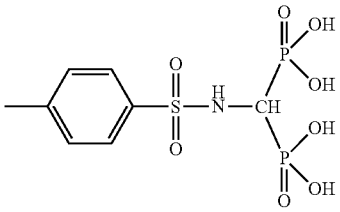

Formula (iii)

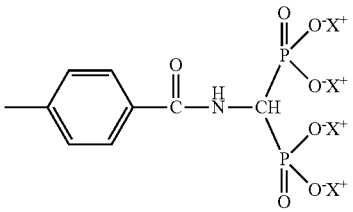

In the formula (iii), $X^+$ represents $Li^+$, $K^+$, $Na^+$, $NH_4^+$, $N(CH_3)_4^+$, $N(C_2H_5)_4^+$, $N(C_3H_7)_4^+$, or $N(C_4H_9)_4^+$.

Formula (iv)

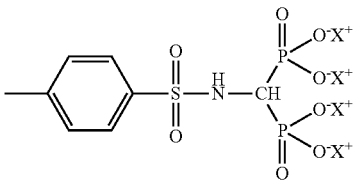

In the formula (iv), $X^+$ represents $Li^+$, $K^+$, $Na^+$, $NH_4^+$, $N(CH_3)_4^+$, $N(C_2H_5)_4^+$, $N(C_3H_7)_4^+$, or $N(C_4H_9)_4^+$.

Pigment Surface Modification Treatment

A pigment surface modification treatment is described below. As an example, a case in which the pigment is modified with a geminal bisphosphonic acid group is described. The modification treatment can be conducted by either of the following method A or B.

Method A

First, 20 g of a carbon black, 20 mmol of the compound having the following formula (v) or (vi), and 200 mL of ion-exchange high-purity water are mixed by a Silverson mixer at a revolution of 6,000 rpm at room temperature. In a case in which the pH of the resulting slurry is higher than 4, 20 mmol of nitric acid is added thereto. Thirty minutes later, 20 mmol of sodium nitrite dissolved in a small amount of ion-exchange high-purity water is gently added to the above mixture. The mixture is heated to 60° C. while being stirred and subjected to a reaction for 1 hour. As a result, a modified pigment is produced in which the compound having the formula (v) or (vi) is added to the carbon black. An NaOH aqueous solution is thereafter added to adjust the pH to 10. As a result, a modified pigment dispersion is obtained 30 minutes later. The modified pigment dispersion is subjected to ultrafiltration using ion-exchange high-purity water and a dialysis membrane and thereafter to ultrasonic dispersion. As a result, the modified pigment dispersion is obtained in which solid contents are condensed.

Method B

A Process All 4HV Mixer (4 L) is filled with 500 g of a dry carbon black, 1 L of ion-exchange high-purity water, and 1 mol of the compound having the following formula (v) or (vi). The mixture is strongly mixed for 10 minutes at a revolution of 300 rpm while being heated to 60° C. A 20% aqueous solution of sodium nitrite (1-mol equivalent based on the compound having the formula (v) or (vi)) is added to the mixture over a period of 15 minutes. The mixture is stir-mixed for 3 hours while being heated to 60° C.

The reaction product is taken out while being diluted with 750 mL of ion-exchange high-purity water. The resulting modified pigment dispersion is subjected to ultrafiltration using ion-exchange high-purity water and a dialysis membrane and thereafter to ultrasonic dispersion. As a result, a modified pigment dispersion is obtained in which solid contents are condensed. In a case in which coarse particles are remaining in large amounts, it is preferable that the coarse particles are removed by a centrifugal separator, etc.

Formula (v)

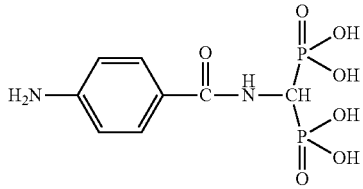

Formula (vi)

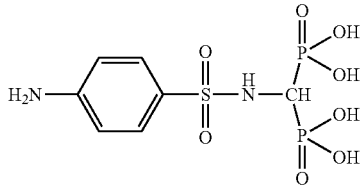

A pH adjuster may be added to the modified pigment dispersion, as necessary. Examples of the pH adjuster include those to be added to the ink (to be described later). In particular, $Na^+$, $N(CH_3)_4^+$, $N(C_2H_5)_4^+$, $N(C_3H_7)_4^+$, and $N(C_4H_9)_4^+$ are preferable.

When treated with a pH adjuster, at least a part of the compound having the formula (v) or (vi) is converted into a salt thereof (i.e., corresponding to the compound having the formula (iii) or (iv)).

Preferably, the resin-coated pigment (3), the surface of which is coated with a resin, is in the form of a polymer emulsion in which the pigment is contained in polymer particles.

In the polymer emulsion, the pigment particles are encapsulated in the polymer particles or adsorbed to the surfaces of the polymer particles. Not all the pigment particles need to be encapsulated in or adsorbed to the polymer particles, and a part of the pigment particles can be solely dispersed in the emulsion without compromising the effect of the present invention.

Examples of the polymer used for the polymer particles include, but are not limited to, vinyl polymers, polyester polymers, and polyurethane polymers. Among these, vinyl polymers and polyester polymers are preferable, which are disclosed in JP-2000-53897-A and JP-2001-139849-A.

In this case, typical organic pigments and composite pigments in which inorganic pigment particles are coated with an organic pigment or carbon black (i.e., colorant) are preferably used. Such a composite pigment may be prepared by a deposition method in which an organic pigment is deposited in the presence of inorganic pigment particles or a mechanochemical method in which an inorganic pigment and an organic pigment are mechanically mixed and ground.

To improve adhesion between the inorganic pigment and the organic pigment, an organosilane compound layer may be formed therebetween from a polysiloxane and an alkylsilane.

In the composite pigment, the mass ratio of the inorganic pigment particles to the colorant (i.e., an organic pigment or carbon black) is preferably from 3/1 to 1/3, and more preferably from 3/2 to 1/2.

When the amount of the colorant is too small, color developing property and coloring power may deteriorate. When the amount of the colorant is too large, transparency and color tone may deteriorate.

Specific preferred examples of the composite pigments in which inorganic pigment particles are coated with an organic pigment or carbon black include, but are not limited to, silica/carbon black composite pigments, silica/phthalocyanine PB 15:3 composite pigments, silica/disazo yellow composite pigments, and silica/quinacridone PR 122 composite pigments, available from TODA KOGYO CORP., the primary average particle diameter of which are small.

In a case in which inorganic pigment particles having a primary particle diameter of 20 nm are coated with the equivalent amount of an organic pigment, the primary particle diameter becomes about 25 nm. If primary particles of the coated inorganic pigment particles can be dispersed with an appropriate dispersant, a pigment ink will be obtained in which very fine particles of the pigment having a dispersion diameter of 25 nm are dispersed.

In the composite pigment, not only the organic pigment present at the surface contributes to dispersion but also the property of the inorganic pigment present in the center appears through the thin organic pigment layer having a thickness of about 2.5 nm. Therefore, a pigment dispersant which can stably disperse both the organic and inorganic pigments is preferably used.

Preferably, the content rate of the colorant in the ink is from 1% to 15% by mass, more preferably from 2% to 10% by mass. When the content rate is 1% by mass or more, color developing power and image density of the ink are sufficient. When the content rate is 15% by mass or less, thickening of the ink and deterioration of dischargeability are prevented, which is preferable in terms of cost.

Water

The water contained in the ink may be pure water such as ion-exchange water, ultrafiltration water, reverse osmosis water, and distilled water, or ultrapure water.

The content rate of the water in the ink is not limited to a specific value.

Polyethylene Wax

Conventionally, a polyethylene wax is known to improve fastness (rub resistance) of the resulting image when contained in an ink. When the content of the polyethylene wax in the ink is increased, however, the polyethylene wax tends to aggregate and coagulate upon evaporation of moisture and clog the nozzles of the discharge head to hinder stable discharge. For this reason, it has been impossible for an ink aiming high productivity (high drying property) to contain an amount of polyethylene wax sufficient to secure image fastness when combined with a conventional head (i.e., trade-off between fastness and discharge stability). On the other hand, when combined with the above circulation-type ink discharge head, the ink can be circulated in the vicinity of the nozzles. Therefore, the polyethylene wax contained in the ink aiming high productivity (high drying property) is prevented from aggregating and coagulating on the inner walls of the nozzles. Thus, it is possible to contain a larger amount of polyethylene wax in the ink while securing stable discharge of the ink. Accordingly, image fastness is drastically improved while stable discharge is secured.

Specific examples of commercially-available products of the polyethylene wax include, but are not limited to, AQ515 (available from BYK Japan KK).

Preferably, the content rate of the polyethylene wax in the ink is from 0.1% to 2.0% by mass, more preferably from 0.2% to 1.8% by mass, based on solid contents.

When the content rate is from 0.1% to 2.0% by mass, fastness (rub resistance) of the resulting image is improved without adversely affecting ink discharge stability.

Surfactant

Preferably, the surfactant comprises a polyether-modified siloxane compound.

When containing a polyether-modified siloxane compound as the surfactant, the ink becomes less wettable to an ink-repellent layer on a nozzle plate of an ink head, thus preventing adhesion of the ink to the nozzle. As a result, defective discharge is prevented and discharge stability is improved.

Preferably, the polyether-modified siloxane compound comprises at least one of the following compounds represented by the formula (III) to (VI), each of which having low dynamic surface tension and appropriate permeability and leveling property while maintaining dispersion stability regardless of the types of colorant and organic solvent used in combination.

Formula (III)

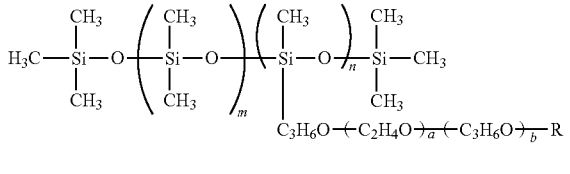

In the formula (III), m represents an integer of from 0 to 23, n represents an integer of from 1 to 10, a represents an integer of from 1 to 23, b represents an integer of from 0 to 23, and R represents hydrogen atom or an alkyl group having 1 to 4 carbon atoms.

Formula (IV)

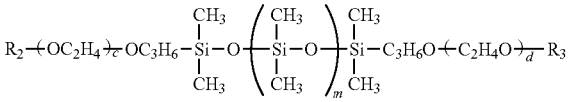

In the formula (IV), m represents an integer of from 1 to 8, each of c and d independently represents an integer of from 1 to 10, and each of $R_2$ and $R_3$ independently represents hydrogen atom or an alkyl group having 1 to 4 carbon atoms.

Formula (V)

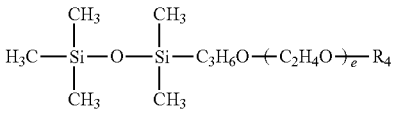

In the formula (V), e represents an integer of from 1 to 8, and $R_4$ represents hydrogen atom or an alkyl group having 1 to 4 carbon atoms.

Formula (VI)

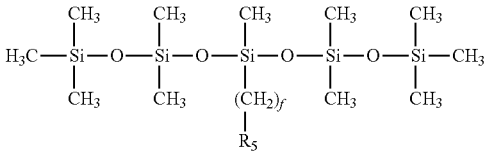

In the formula (VI), f represents an integer of from 1 to 8, and $R_5$ represents a polyether group represented by the following formula (A).

Formula (A)

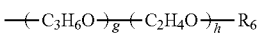

In the formula (A), g represents an integer of from 0 to 23, h represents an integer of from 0 to 23, excluding the case in which both of g and h represent 0 at the same time, and $R_6$ represents hydrogen atom or an alkyl group having 1 to 4 carbon atoms.

Specific examples of the polyether-modified siloxane compound represented by the formula (III) include the following compounds.

Formula (VI′)

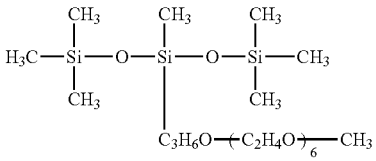

Formula (VII′)

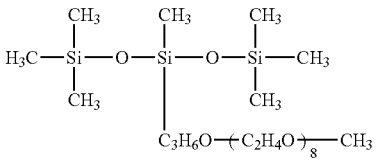

Formula (VIII)

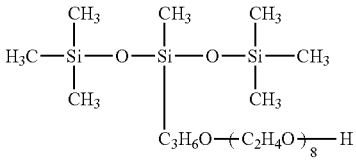

-continued

Formula (IX)

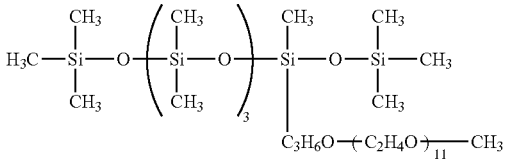

Formula (X)

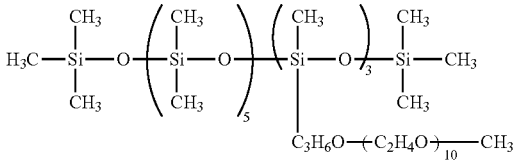

Formula (XI)

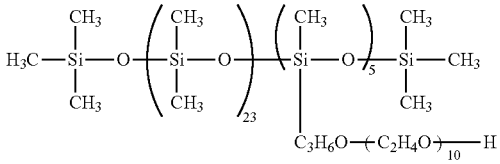

Formula (XII)

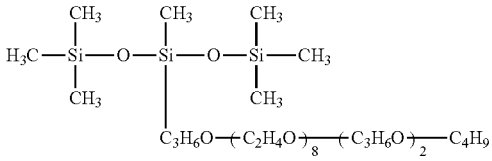

Formula (XIII)

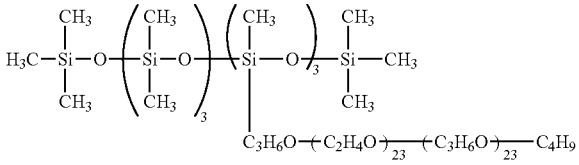

Specific examples of the polyether-modified siloxane compound represented by the formula (IV) include the following compound.

Formula (XIV)

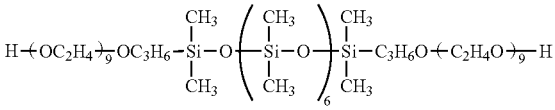

Specific examples of the polyether-modified siloxane compound represented by the formula (V) include the following compound.

Formula (XV)

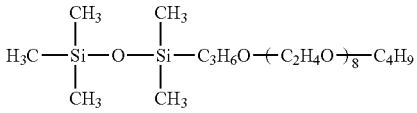

Specific examples of the polyether-modified siloxane compound represented by the formula (VI) include the following compounds.

Formula (XVI)

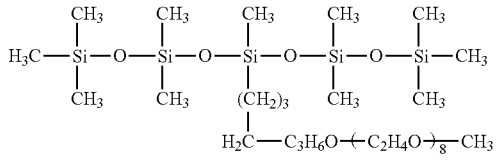

Formula (XVII)

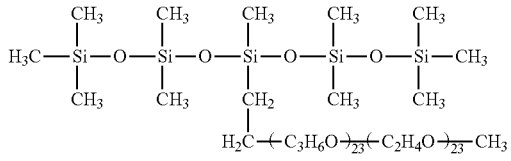

Formula (XVIII)

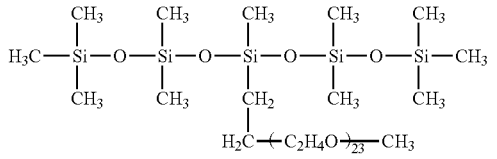

These polyether-modified siloxane compounds are available either synthetically or commercially.

The polyether-modified siloxane compound may be synthesized based on the methods described in, for example, JP-5101598-B, JP-5032325-B, and JP-5661229-B.

Specifically, the polyether-modified siloxane compound may be synthesized by a hydrosilylation reaction between a polyether (A) (hereinafter may be referred to as "component (A)") and an organohydrogen siloxane (B) (hereinafter may be referred to as "component (B)").

The polyether (A) is a polyoxyalkylene copolymer represented by —($C_nH_{2n}O$)—, where n representing a numeral ranging from 2 to 4.

The polyoxyalkylene copolymer may have oxyethylene units —($C_2H_4O$)—, oxypropylene units —($C_3H_6O$)—, oxybutylene units —($C_4H_8O$)—, or mixture units thereof. These oxyalkylene units are not limited in arrangement and may form a block structure or a random copolymer structure. Preferably, the oxyalkylene units form a random copolymer structure. Preferably, the polyoxyalkylene includes both oxyethylene units ($C_2H_4O$) and oxypropylene units ($C_3H_6O$) in the random copolymer structure.

The organohydrogen siloxane (B) is an organopolysiloxane having at least one hydrogen bound to silicon (i.e., SiH) per molecule. The organopolysiloxane may include any combination and number of siloxy units such as ($R_3Si_{0.5}$), ($R_2SiO$), ($RSiO_{1.5}$), and ($SiO_2$), where each of R independently representing an organic group or a hydrocarbon group.

When R represents methyl group in each of the siloxy units ($R_3SiO_{0.5}$), ($R_2SiO$), and ($RSiO_{1.5}$), these siloxy units are represented as M unit, D unit, and T unit, respectively. The siloxy unit ($SiO_2$) is represented as Q unit.

The organohydrogen siloxane has a similar structure in which at least one SiH exists in the siloxy unit.

Methyl-based siloxy units in the organohydrogen siloxane are represented as $M^H$ siloxy unit ($R_2HSiO_{0.5}$), $D^H$ siloxy unit (RHSiO), and $T^H$ siloxy unit ($HSiO_{1.5}$).

The organohydrogen siloxane may include any number of M, $M^H$, D, $D^H$, T, $T^H$, and Q siloxy units so long as at least one siloxy unit includes SiH.

The components (A) and (B) are subjected to a hydrosilylation reaction. Preferably, the hydrosilylation reaction is performed in the presence of a hydrosilylation catalyst.

Specific examples of the hydrosilylation catalyst include, but are not limited to, metals such as platinum, rhodium, ruthenium, palladium, osmium, and iridium; organic metal compounds of the metals; and combinations thereof.

Preferably, the content of the hydrosilylation catalyst is from 0.1 to 1,000 ppm, more preferably from 1 to 100 ppm, based on total weight of the components (A) and (B).

The hydrosilylation reaction may be performed either without dilution or in the presence of a solvent. Preferably, the hydrosilylation reaction is performed in the presence of a solvent.

Specific examples of the solvent include, but are not limited to, alcohols (e.g., methanol, ethanol, isopropanol, butanol, n-propanol), ketones (e.g., acetone, methyl ethyl ketone, methyl isobutyl ketone), aromatic hydrocarbons (e.g., benzene, toluene, xylene), aliphatic hydrocarbons (e.g., heptane, hexane, octane), glycol ethers (e.g., propylene glycol methyl ether, dipropylene glycol methyl ether, propylene glycol n-butyl ether, propylene glycol n-propyl ether, ethylene glycol n-butyl ether), halogenated hydrocarbons (e.g., dichloromethane, 1,1,1-trichloroethane, methylene chloride, chloroform), dimethylsulfoxide, dimethylformamide, acetonitrile, tetrahydrofuran, volatile oils, mineral spirit, and naphtha. Each of these solvents can be used alone or in combination with others.

The quantitative ratio between the components (A) and (B) that are to be subjected to the hydrosilylation reaction is not limited and may be presented as a molar ratio between unsaturated groups in the component (A) and SiH in the component (B). Preferably, the amount of unsaturated groups in the polyether (A) is 20% by mole or less, more preferably 10% by mole or less, of the amount of SiH in the organohydrogen siloxane (B).

The hydrosilylation reaction may be performed by any of batch methods, semi continuous methods, and continuous methods. As an example, a continuous method using a plug flow reactor may be employed.

Specific examples of commercially-available products of the polyether-modified siloxane compound include, but are not limited to, 71 ADDITIVE, 74 ADDITIVE, 57 ADDITIVE, 8029 ADDITIVE, 8054 ADDITIVE, 8211 ADDITIVE, 8019 ADDITIVE, 8526 ADDITIVE, FZ-2123, and FZ-2191 (available from Dow Corning Toray Co., Ltd.); TSF4440, TSF4441, TSF4445, TSF4446, TSF4450, TSF4452, and TSF4460 (available from Momentive Performance Materials Inc.); SILFACE SAG002, SILFACE SAG003, SILFACE SAG005, SILFACE SAG503A, SILFACE SAG008, and SILFACE SJM003 (available from Nissin Chemical Industry Co., Ltd.); TEGO Wet KL245, TEGO Wet 250, TEGO Wet 260, TEGO Wet 265, TEGO Wet 270, and TEGO Wet 280 (available from Evonik Japan Co., Ltd.); and BYK-345, BYK-347, BYK-348, BYK-375, and BYK-377 (available from BYK Japan KK). Each of these products can be used alone or in combination with others.

Among these, TEGO Wet 270 (available from Evonik Japan Co., Ltd.) and SILFACE SAG503A (available from Nissin Chemical Industry Co., Ltd.) are preferable.

The polyether-modified siloxane compound may be used in combination with a fluorine-based surfactant, a silicone-based surfactant, acetylene glycol, or an acetylene-alcohol-based surfactant.

Preferably, the content rate of the surfactant in the ink is from 0.001% to 5% by mass, more preferably from 0.5% to 3% by mass. When the content rate is from 0.001% to 5% by mass, the ink becomes less wettable to an ink-repellent layer on a nozzle plate of an ink head, thus preventing adhesion of the ink to the nozzle. As a result, defective discharge is prevented and discharge stability is improved.

Other Components

The ink may further contain other components such as water-dispersible resin, foam inhibitor (defoamer), pH adjuster, preservative and fungicide, chelate agent, corrosion inhibitor, antioxidant, ultraviolet absorber, oxygen absorber, and photostabilizer.

Water-Dispersible Resin

Water-dispersible resins have excellent film-forming property (i.e., image forming property), high water-repellent property, high water resistance, and high fade resistance. Therefore, the use of water-dispersible resins is advantageous for recording images having high water resistance and high image density (i.e., high color developing property).

Examples of the water-dispersible resins include, but are not limited to, condensation-type synthetic resins, addition-type synthetic resins, and natural polymers. Each of these resins can be used alone or in combination with others.

Specific examples of the condensation-type synthetic resins include, but are not limited to, polyester resin, polyurethane resin, polyepoxy resin, polyamide resin, polyether resin, polyacrylic or polymethacrylic resin, acrylic-silicone resin, and fluorine-based resin.

Specific examples of the addition-type synthetic resins include, but are not limited to, polyolefin resin, polystyrene resin, polyvinyl alcohol resin, polyvinyl ester resin, polyacrylic acid resin, and unsaturated carboxylic acid resin.

Specific examples of the natural polymers include, but are not limited to, celluloses, rosins, and natural rubbers.

Among these, fluorine-based resin and acrylic-silicone resin are preferable.

Preferably, the fluorine-based resin comprises a fluorine-based resin having a fluoroolefin unit, more preferably a fluorine-containing vinyl ether resin having a fluoroolefin unit and a vinyl ether unit.

Examples of the fluoroolefin unit include, but are not limited to, $—CF_2CF_2—$, $—CF_2CF(CF_3)—$, and $—CH_2CFCl—$.

Examples of the vinyl ether unit include the following units, but are not limited thereto.

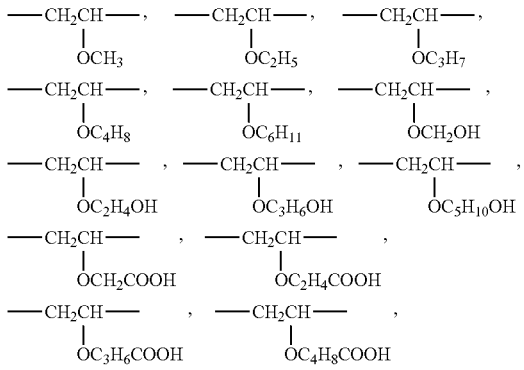

-continued

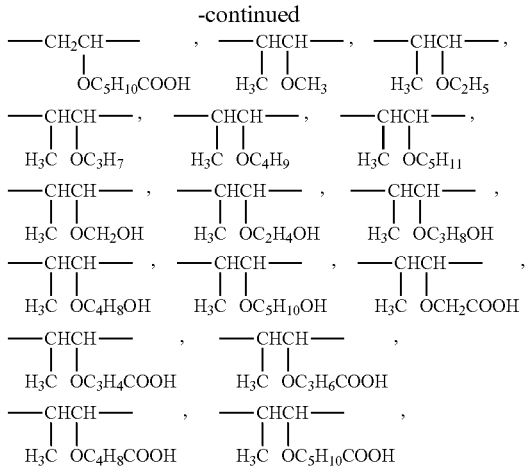

Preferably, the fluorine-containing vinyl ether resin having a fluoroolefin unit and a vinyl ether unit is an alternate copolymer in which the fluoroolefin unit and the vinyl ether unit are copolymerized in an alternating manner.

The fluorine-based resin is available either synthetically or commercially. Specific examples of commercially-available products of the fluorine-based resin include, but are not limited to: FLUONATE series FEM-500 and FEM-600, DIC GUARD series F-52S, F-90, F-90M, and F-90N, and AQUAFLUN TE-5A (products of DIC Corporation); and LUMIFLON series FE4300, FE4500, and FE4400, and ASAHI GUARD series AG-7105, AG-950, AG-7600, AG-7000, and AG-1100 (products of Asahi Glass Co., Ltd.).

The water-dispersible resin may be either a homopolymer or a copolymer (i.e., composite resin). The water-dispersible resin may be of a single-phase structure type, a core-shell type, or a power-feed-type emulsion.

The water-dispersible resin may be either a self-dispersible resin having a hydrophilic group or a-non-self-dispersible resin to which dispersibility has been imparted by a surfactant or a resin having a hydrophilic group. In particular, an emulsion of resin particles obtained by an emulsion polymerization or suspension polymerization of ionomers or unsaturated monomers of polyester or polyurethane resin is preferably used as the water-dispersible resin. In a case in which a resin emulsion is obtained by an emulsion polymerization of unsaturated monomers, the unsaturated monomers are reacted in water containing a polymerization initiator, a surfactant, a chain transfer agent, a chelate agent, a pH adjuster, etc. This is an easy way of obtaining the water-dispersible resin and varying the resin composition in accordance with use purpose.

Specific examples of the unsaturated monomers include, but are not limited to, unsaturated carboxylic acids, monofunctional or polyfunctional acrylate and methacrylate monomers, acrylamide and methacrylamide monomers, aromatic vinyl monomers, vinylcyano compound monomers, vinyl monomers, allyl compound monomers, olefin monomers, diene monomers, and oligomers containing unsaturated carbon. These monomers can be used alone or in combination with others. By combining these monomers, the resin can be flexibly reformed. Specifically, the resin can be reformed by a polymerization or graft reaction using an oligomer-type polymerization initiator.

Specific examples of the unsaturated carboxylic acids include, but are not limited to, acrylic acid, methacrylic acid, itaconic acid, fumaric acid, and maleic acid.

Specific examples of the monofunctional acrylate and methacrylate monomers include, but are not limited to, methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethylhexyl methacrylate, octyl methacrylate, decyl methacrylate, dodecyl methacrylate, octadecyl methacrylate, cyclohexyl methacrylate, phenyl methacrylate, benzyl methacrylate, glycidyl methacrylate, 2-hydroxyethyl methacrylate, 2-hydroxypropyl methacrylate, dimethylaminoethyl methacrylate, methacryloxyethyl trimethyl ammonium salt, 3-methacryloxypropyl trimethoxysilane, methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, octyl acrylate, decyl acrylate, dodecyl acrylate, octadecyl acrylate, cyclohexyl acrylate, phenyl acrylate, benzyl acrylate, glycidyl acrylate, 2-hydroxyethyl acrylate, 2-hydroxypropyl acrylate, dimethylaminoethyl acrylate, and acryloxyethyl trimethyl ammonium salt.

Specific example of the polyfunctional acrylate and methacrylate monomers include, but are not limited to, ethylene glycol dimethacrylate, diethylene glycol dimethacrylate, triethylene glycol dimethacrylate, polyethylene glycol dimethacrylate, 1,3-butylene glycol dimethacrylate, 1,4-butylene glycol dimethacrylate, 1,6-hexanediol dimethacrylate, neopentyl glycol dimethacrylate, dipropylene glycol dimethacrylate, polypropylene glycol dimethacrylate, polybutylene glycol dimethacrylate, 2,2'-bis(4-methacryloxydiethoxyphenyl)propane, trimethylolpropane trimethacrylate, trimethylolethane trimethacrylate, polyethylene glycol diacrylate, triethylene glycol diacrylate, 1,3-butylene glycol diacrylate, 1,4-butylene glycol diacrylate, 1,6-hexanediol diacrylate, neopentyl glycol diacrylate, 1,9-nonanediol diacrylate, polypropylene glycol diacrylate, 2,2'-bis(4-acryloxypropyloxyphenyl)propane, 2,2'-bis(4-acryloxydiethoxyphenyl)propane trimethylolpropane triacrylate, trimethylolethane triacrylate, tetramethylolmethane triacrylate, ditrimethylol tetraacrylate, tetramethylolmethane tetraacrylate, pentaerythritol tetraacrylate, and dipentaerythritol hexaacrylate.

Specific examples of the acrylamide and methacrylamide monomers include, but are not limited to, acrylamide, methacrylamide, N,N-dimethylacrylamide, methylenebis acrylamide, 2-acrylamido-2-methylpropane sulfonic acid.

Specific examples of the aromatic vinyl monomers include, but are not limited to, styrene, α-methylstyrene, vinyl toluene, 4-t-butylstyrene, chlorostyrene, vinylanisol, vinylnaphthalene, and divinylbenzene.

Specific examples of the vinylcyano compound monomers include, but are not limited to, acrylonitrile and methacrylonitrile.

Specific examples of the vinyl monomers include, but are not limited to, vinyl acetate, vinylidene chloride, vinyl chloride, vinyl ether, vinyl ketone, vinyl pyrrolidone, vinylsulfonic acid and salts thereof, vinyl trimethoxysilane, and vinyl triethoxysilane.

Specific examples of the allyl compound monomers include, but are not limited to, allylsulfonic acid and salts thereof, allylamine, allyl chloride, diallylamine, and diallyldimethylammonium salt.

Specific examples of the olefin monomers include, but are not limited to, ethylene and propylene.

Specific examples of the diene monomers include, but are not limited to, butadiene and chloroprene.

Specific examples of the oligomers containing unsaturated carbon include, but are not limited to, styrene oligomer having methacryloyl group, styrene-acrylonitrile oligomer having methacryloyl group, methyl methacrylate oligomer having methacryloyl group, dimethylsiloxane oligomer having methacryloyl group, and polyester oligomer having acryloyl group.

In the water-dispersible resin, molecular chain cleavage phenomena, such as dispersion destruction and hydrolysis, may be caused under a strongly basic or acidic environment. Therefore, preferably, the pH of the resin dispersion is from 4 to 12. For more improving miscibility with water-dispersible colorants, the pH is preferably from 6 to 11 and more preferably from 7 to 11.

The volume average particle diameter of the water-dispersible resin correlates with the viscosity of the dispersion liquid. As the particle diameter becomes smaller, the viscosity becomes larger under the same composition. Preferably, the volume average particle diameter of the water-dispersible resin is at least 50 nm, so as not to excessively increase the viscosity of the ink.

When the particle diameter is several tens of micrometers, the ink cannot be used because the resin particles are larger than nozzle openings of an inkjet head. Even being smaller than nozzle openings, large resin particles present in the ink will degrade dischargeability of the ink. Accordingly, preferably, the volume average particle diameter is 200 nm at most, more preferably 150 nm at most, so as not to degrade ink dischargeability.

The water-dispersible resin has a function of fixing the colorant on the surface of a recording medium and another function of improving fixability of the colorant by being formed into a film at room temperature. Therefore, preferably, the minimum film-forming temperature (MFT) of the water-dispersible resin is 30° C. or less. In addition, preferably, the glass transition temperature of the water-dispersible resin is −30° C. or more, because, when the glass transition temperature is −40° C. or less, the resulting film becomes so viscid that tackiness is given to the print.

Preferably, the content rate of the water-dispersible resin in the ink is from 0.5% to 10% by mass, more preferably from 1% to 8% by mass.

Foam Inhibitor (Defoamer)

The ink may contain a foam inhibitor (defoamer) in a slight amount for suppressing bubble formation. Here, the bubble formation refers to a phenomenon in which a liquid becomes a thin film and encloses the air. Whether bubble formation occurs or not depends on the properties of ink, such as surface tension and viscosity. For example, a liquid having a high surface tension, such as water, is unlikely to cause bubble formation because a force for minimizing the surface area of the liquid generates in the liquid. On the other hand, a highly-viscous and highly-permeable ink is likely to cause bubble formation due to its low surface tension. The generated bubbles are likely to maintain due to the high viscosity of the ink.

The foam inhibitor is of two types: those destroy bubbles by locally reducing the surface tension of the bubble film; and those insoluble in a bubbled liquid that destroy bubbles by being scattered on the surface of the bubbled liquid. When the polyether-modified siloxane compound, having a very strong function of reducing surface tension, is contained in ink as a surfactant, the foam inhibitor of the former type is generally not used because of being unable to locally reduce the surface tension of the bubble film. Therefore, in this case, the foam inhibitor of the latter type that is insoluble in a bubbled liquid is used while degrading the stability of ink.

On the other hand, a foam inhibitor represented by the following formula (a) has high compatibility with the polyether-modified siloxane compound, although the function of reducing surface tension is not as strong as that of the polyether-modified siloxane compound. Such a foam inhibitor can be effectively incorporated into the bubble film. Due to the difference in surface tension between the polyether-modified siloxane compound and this foam inhibitor, the surface of the bubble film becomes locally imbalanced and the bubbles are destroyed.

Formula (a)

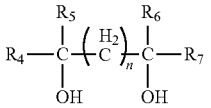

In the formula (a), each of $R_4$ and $R_5$ independently represents an alkyl group having 3 to 6 carbon atoms, each of $R_6$ and $R_7$ independently represents an alkyl group having 1 to 2 carbon atoms, and n represents an integer of from 1 to 6.

Specific preferred examples of the compound represented by the formula (a) include, but are not limited to, 2,4,7,9-tetramethyldecane-4,7-diol and 2,5,8,11-tetramethyldodecane-5,8-diol. Among these, 2,5,8,11-tetramethyldodecane-5,8-diol is preferable for its high foam inhibiting effect and compatibility with the ink.

The content rate of the foam inhibitor in the ink is preferably is from 0.01% to 10% by mass, more preferably from 0.1% to 5% by mass. When the content is 0.01% by mass or more, foam inhibiting effect is exerted. When the content is 10% by mass or less, foam inhibiting effect is well exerted and the ink properties such as viscosity and particle diameter become appropriate.

pH Adjuster

The pH adjuster is not limited to a specific material so long as it can adjust the pH of the ink to 7 to 11 without adversely affecting the ink. Specific examples of the pH adjuster include, but are not limited to, alcohol amines, alkali metal hydroxides, ammonium hydroxides, phosphonium hydroxides, and alkali metal carbonates. When the pH is less than 7 or in excess of 11, inkjet heads and/or ink supply units may be dissolved out in large amounts, thereby causing alternation, leakage, and defective discharge of the ink.

Specific examples of the alcohol amines include, but are not limited to, diethanolamine, triethanolamine, and 2-amino-2-ethyl-1,3-propanediol.

Specific examples of the alkali metal hydroxides include, but are not limited to, lithium hydroxide, sodium hydroxide, and potassium hydroxide.

Specific examples of the ammonium hydroxides include, but are not limited to, ammonium hydroxide and quaternary ammonium hydroxide.

Specific examples of the phosphonium hydroxides include, but are not limited to, quaternary phosphonium hydroxide.

Specific examples of the alkali metal carbonates include, but are not limited to, lithium carbonate, sodium carbonate, and potassium carbonate.

Preservative and Fungicide

Specific examples of the preservative and fungicide include, but are not limited to, sodium dehydroacetate, sodium sorbate, 2-pyridinethiol-1-oxide sodium salt, sodium benzoate, and pentachlorophenol sodium.

Chelate Agent

Specific examples of the chelate agent include, but are not limited to, ethylenediaminetetraacetic acid sodium salt, nitrilotriacetic acid sodium salt, hydroxyethylethylenediaminetriacetic acid sodium salt, diethylenetriaminepentaacetic acid sodium salt, and uramildiacetic acid sodium salt.

Corrosion Inhibitor

Specific examples of the corrosion inhibitor include, but are not limited to, acid sulphite, sodium thiosulfate, ammonium thiodiglycolate, diisopropylammonium nitrite, pentaerythritol tetranitrate, and dicyclohexylammonium nitrite.

Antioxidant

Specific examples of the antioxidant include, but are not limited to, phenol-based antioxidants (including hindered-phenol-based antioxidants), amine-based antioxidants, sulfur-based antioxidants, and phosphor-based antioxidants.

Method for Manufacturing Ink

In accordance with some embodiments of the present invention, the ink may be manufactured by dispersing or dissolving the colorant, the organic solvent, and water, preferably along with the surfactant and the water-dispersible resin, and optional components, if any, in water, optionally while stir-mixing them. The stir-mixing may be performed by a sand mill, homogenizer, ball mill, paint shaker, ultrasonic disperser, stirrer equipped with stirring blades, magnetic stirrer, or high-speed disperser.

Ink Properties

The properties of the ink, such as viscosity and surface tension, are not particularly limited and can be suitably selected to suit to a particular application.

Preferably, the ink has a viscosity of from 5 to 25 mPa·s, more preferably from 6 to 20 mPa·s, at 25° C. When the ink viscosity is 5 mPa·s or more, print density and text quality are improved. When the ink viscosity is 25 mPa·s or less, discharge stability is secured.

The viscosity can be measured by a viscometer (RE-550 L available from Toki Sangyo Co., Ltd.) at 25° C.

Recording Medium

In accordance with some embodiments of the present invention, recording media, such as plain paper, gloss paper, special paper, and cloth, can be used. Also, non-permeating substrates are preferably used for reliably forming images.

The non-permeating substrate has a surface with a low level of moisture permeability and absorptivity. Examples of such a non-permeating substrate include a material having a number of hollow spaces inside but not open to the exterior. To be more quantitative, the non-permeating substrate refers to a substrate that absorbs water in an amount of 10 $mL/m^2$ or less from the start of contact to 30 $msec^{1/2}$ after the start of contact, when measured according to the Bristow method.

Specific examples of the non-permeating substrate include, but are not limited to, plastic films such as vinyl chloride resin films, polyethylene terephthalate (PET) films, polypropylene films, polyethylene films, and polycarbonate films.

Recorded Matter

In accordance with some embodiments of the present invention, a recorded matter is provided. The recorded matter includes the recording medium and an image formed with the ink on the recording medium.

The recorded matter may be manufactured by an inkjet recording device and an inkjet recording method.

Recording Device and Recording Method

The ink according to an embodiment of the present invention can be suitably applied to various recording devices employing an inkjet recording method, such as printers, facsimile machines, photocopiers, multifunction peripherals (having the functions of printer, facsimile machine, and photocopier), and three-dimensional objects manufacturing devices.

In the present disclosure, the recording device and the recording method respectively represent a device capable of discharging inks or various treatment liquids to a recording medium and a method for recording an image on the recording medium using the device. The recording medium refers to an article to which the inks or the various treatment liquids can be attached at least temporarily.

The recording device may further optionally include devices relating to feeding, conveying, and ejecting of the recording medium and other devices referred to as a pre-treatment device or an aftertreatment device, in addition to the ink discharger.

The recording device may further optionally include a heater for use in the heating process and a dryer for use in the drying process. Examples of the heater and the dryer include devices for heating and drying the printed surface and the reverse surface of a recording medium. Specific examples of the heater and the dryer include, but are not limited to, a fan heater and an infrared heater. The heating process and the drying process may be performed either before, during, or after printing.

In addition, the recording device and the recording method are not limited to those producing merely meaningful visible images such as texts and figures with the ink. For example, the recording device and the recording method can produce patterns like geometric design and three-dimensional images. The recording device includes both a serial-type device in which the discharge head is movable and a line-type device in which the discharge head is unmovable. The discharge head is a circulation-type discharge head configured to circulate a liquid within multiple individual liquid chambers. The circulation-type discharge head is described in detail later.

Furthermore, in addition to the desktop type, the recording device includes a device capable of printing images on a large recording medium with A0 size and a continuous printer capable of using continuous paper reeled up in a roll form as recording media.

Figure 2:
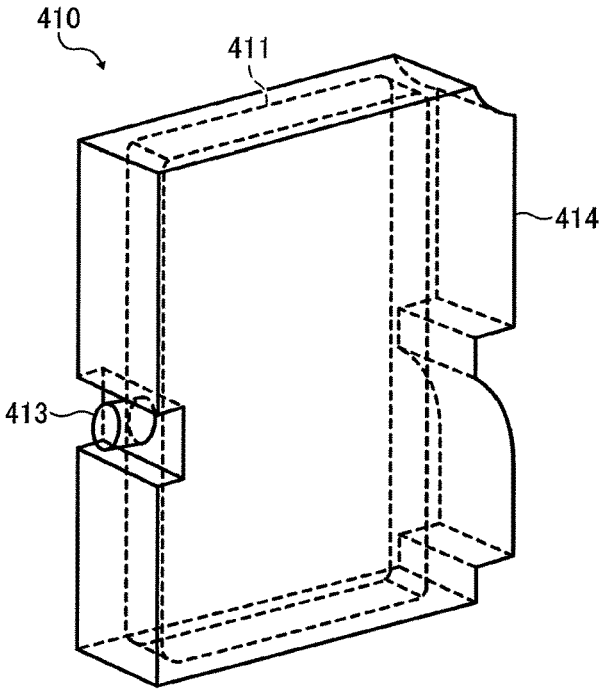
FIG. 2 is a schematic perspective view of an ink storage container in accordance with some embodiments of the present invention.

As one example of the recording device according to an embodiment of the present invention, an image forming apparatus 400 is described in detail below with reference to FIGS. 1 and 2. FIG. 1 is a perspective view of an image forming apparatus 400. FIG. 2 is a perspective view of a main tank for use in the image forming apparatus 400. The image forming apparatus 400 is a serial-type image forming apparatus. A mechanical unit 420 is disposed in a housing 401 of the image forming apparatus 400. Main tanks 410*k*, 410*c*, 410*m*, and 410*y* for respective color of black (K), cyan (C), magenta (M), and yellow (Y) (hereinafter collectively referred to as "main tank 410") each include an ink container 411. Each ink container 411 is made of a packaging member such as an aluminum laminate film. The ink container 411 is accommodated in a container casing 414 made of plastic. As a result, the main tank 410 is used as an ink cartridge of each color.

A cartridge holder 404 is disposed on the rear side of the opening when a cover 401*c* is opened. The main tank 410 is detachably attachable to the cartridge holder 404. As a result, each ink discharging outlet 413 of the main tank 410 communicates with a discharge head 434 for each color via a supplying tube 436 for each color so that the ink can be discharged from the discharge head 434 to a recording medium.

The ink may be applied not only to inkjet recording method but also to other methods in various fields. Specific examples of such methods other than inkjet recording method include, but are not limited to, blade coating methods, gravure coating methods, bar coating methods, roll coating methods, dip coating methods, curtain coating methods, slide coating methods, die coating methods, and spray coating methods.

The applications of the ink of the present disclosure are not particularly limited. For example, the ink can be used for printed matter, a paint, a coating material, and foundation. The ink can be used to form two-dimensional texts and images and furthermore three-dimensional objects.

The apparatus for manufacturing three-dimensional objects can be any known device with no particular limit. For example, the apparatus includes an ink container, a supplier, a discharger, a dryer, etc. The three-dimensional object includes an object produced by re-applying ink over and over. In addition, the three-dimensional object includes a processed product produced by processing a structure including a substrate (such as a recording medium) and an ink applied thereon. The processed product is fabricated by, for example, heating drawing or punching a structure or recorded matter having a sheet-like form, film-like form, etc. The processed product is suitable for what is formed after surface-decorating. Examples thereof are gauges or operation panels of vehicles, office machines, electric and electronic devices, cameras, etc.

Ink Discharge Head

The ink discharge head includes a nozzle configured to discharge the ink, an individual liquid chamber communicated with the nozzle, a flow-in channel configured to let the ink flow into the individual liquid chamber, and a flow-out channel configured to let the ink flow out from the individual liquid chamber.

Preferably, the ink discharge head is connected to an ink supplier configured to supply the ink to the individual liquid chamber via the flow-in channel. Since the ink discharge device includes the circulator, preferably, the flow-out channel and the ink supplier are connected to each other so that the ink can be circulated between the ink discharge head and the ink supplier. Such a configuration is advantageous in that the amount of waste ink outflowed from the flow-out channel can be reduced.

Circulator

The circulator is configured to circulate the ink by letting the ink flow into the individual liquid chamber via the flow-in channel and flow out from the individual liquid chamber via the flow-out channel.

Preferably, the circulator is configured to circulate the ink before the ink discharge head discharges the ink.

The ink discharge head can discharge the ink either after the circulator has terminated the circulation of the ink or while the circulator keeps circulating the ink.

Examples of the circulator include, but are not limited to, a liquid feed pump.

Other Components

The ink discharge device may further include an ink storage container storing the ink, an ink supplier configured to supply the ink to the individual liquid chamber via the flow-in channel, and inward and outward liquid feed channels configured to circulate the ink between the ink storage container and the ink supplier.

Ink Storage Container

The ink storage container (hereinafter may be referred to as "ink cartridge", "cartridge", or "main tank") stores the ink. The ink storage container is connected to the ink supplier via the inward and outward liquid feed channels so that the ink can be circulated therebetween.

Ink Supplier

The ink supplier is configured to supply the ink to the individual liquid chamber via the flow-in channel. Preferably, the circulator circulates the ink between the ink supplier and the ink discharge head via the flow-in channel and the flow-out channel. More preferably, the ink is circulated between the ink supplier and the ink storage container via the inward and outward liquid feed channels.

Liquid Feed Channels

The inward and outward liquid feed channels are configured to circulate the ink between the ink storage container and the ink supplier.

Recording Device and Recording Method Using Circulation-Type Discharge Head

Figure 3:
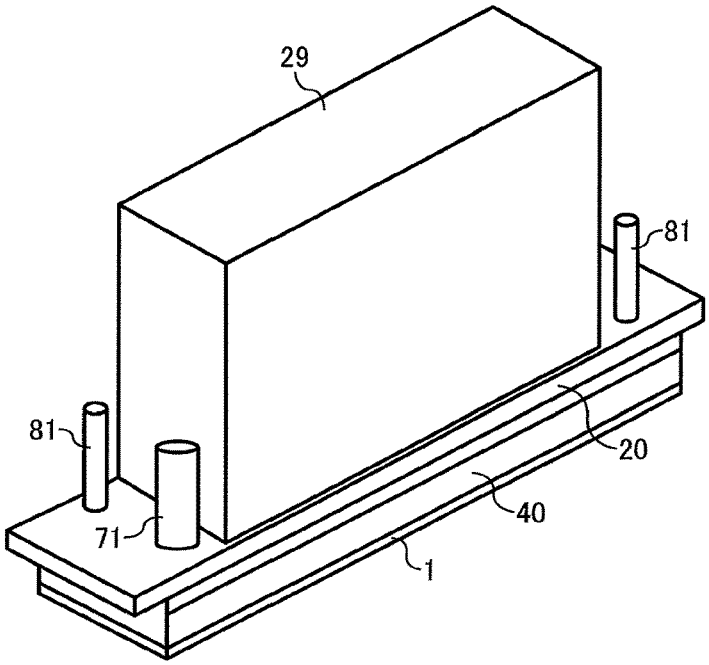
FIG. 3 is a schematic perspective view of an outline of an ink discharge head in accordance with some embodiments of the present invention.
Figure 4:
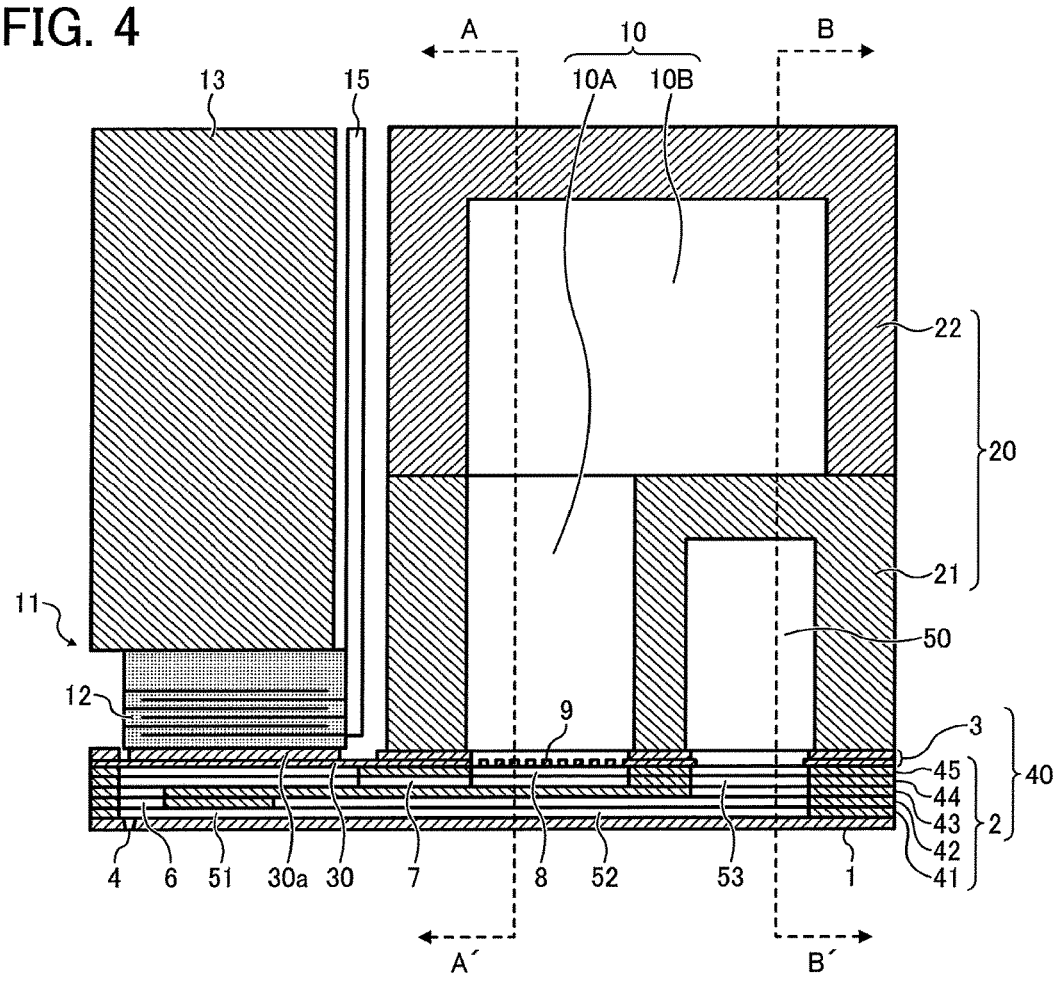
FIG. 4 is a cross-sectional view of the ink discharge head illustrated in FIG. 3 in a direction perpendicular to the nozzle array direction.
Figure 5:
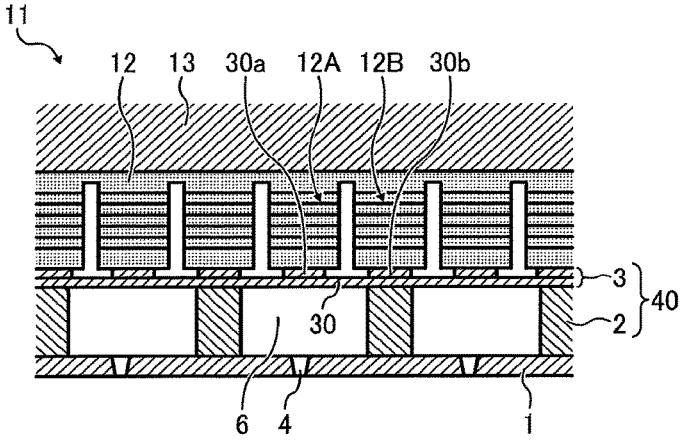
FIG. 5 is a cross-sectional view of the ink discharge head illustrated in FIG. 3 in a direction parallel to the nozzle array direction.
Figure 6:
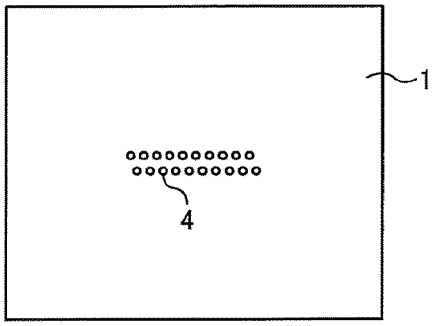
FIG. 6 is a plan view of a nozzle plate of the ink discharge head illustrated in FIG. 3.

One example of the circulation-type discharge head is described below with reference to FIGS. 3 to 8. FIG. 3 is an outline perspective view of the circulation-type discharge head (hereinafter simply "head"). FIG. 4 is a cross-sectional view of the head in a direction perpendicular to the nozzle array direction. FIG. 5 is a cross-sectional view of the head in a direction parallel to the nozzle array direction. FIG. 6 is a plan view of a nozzle plate of the head. FIGS. 7A to 7F are plan views of members constituting a channel substrate of the head. FIGS. 8A and 8B are plan views of members constituting a common liquid chamber substrate of the head.

In the head, a nozzle plate 1, a channel plate 2, and a diaphragm 3 as a wall member are attached to and laminated on each other. The head further includes a piezoelectric actuator 11 that displaces the diaphragm 3, a common liquid chamber substrate 20, and a cover 29.

The nozzle plate 1 includes multiple nozzles 4 that discharge liquid.

The channel plate 2 forms an individual liquid chamber 6 in communication with the nozzle 4, a fluid resistance part 7 in communication with the individual liquid chamber 6, and a liquid introduction part 8 in communication with the fluid resistance part 7. The channel plate 2 is formed of multiple plate-like members 41 to 45 attached to each other in a lamination manner on the nozzle plate 1. The plate-like members 41 to 45 and the diaphragm 3 are attached to and laminated on each other to form a channel substrate 40.

The diaphragm 3 includes a filter part 9 serving as an opening in communication with a common liquid chamber 10 formed of the liquid introduction part 8 and the common liquid chamber substrate 20.

The diaphragm 3 is a wall member forming the wall of the individual liquid chamber 6 of the channel plate 2. This diaphragm 3 employs a two-layered structure (but not limited thereto) including, from the channel plate 2 side, the first layer forming a thin portion and the second layer forming a thick portion. A vibration area 30 that is deformable is formed at the portion of the first layer corresponding to the individual liquid chamber 6.

The nozzle plate 1 includes multiple nozzles 4 arranged in a zigzag manner, as illustrated in FIG. 6.

Figure 7A:
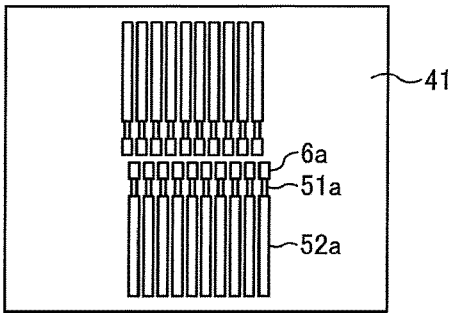
FIGS. 7A to 7F are plan views of members constituting a channel substrate of the ink discharge head illustrated in FIG. 3.
Figure 8A:
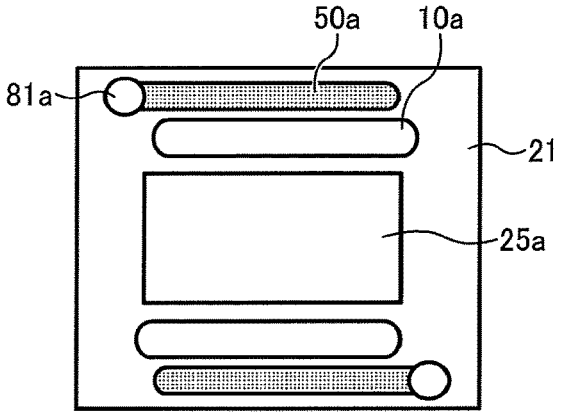
FIGS. 8A and 8B are plan views of members constituting a common liquid chamber substrate of the ink discharge head illustrated in FIG. 3.
Figure 8B:
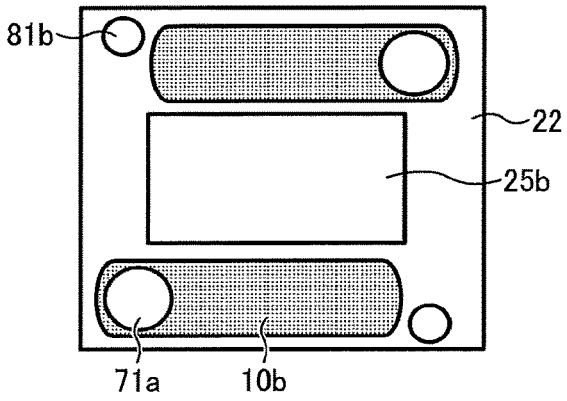

As illustrated in FIG. 7A, the plate-like member 41 constituting the channel plate 2 includes through grooves (meaning through holes having a groove form) 6*a* each constituting the individual liquid chamber 6, through grooves 51*a* each constituting a fluid resistance part 51, and through grooves 52*a* each constituting a circulation channel 52.

Figure 7B:
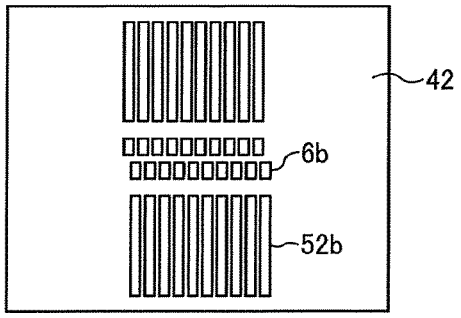

As illustrated in FIG. 7B, the plate-like member 42 includes through grooves 6*b* each constituting the individual liquid chamber 6 and through grooves 52*b* each constituting the circulation channel 52.

Figure 7C:
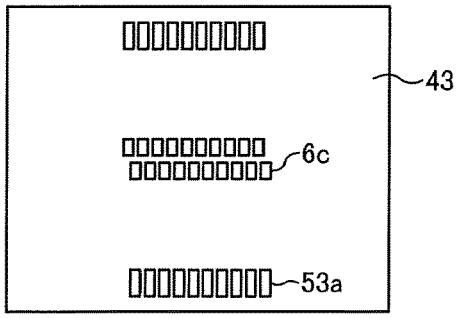

As illustrated in FIG. 7C, the plate-like member 43 includes through grooves 6*c* each constituting the individual liquid chamber 6 and through grooves 53*a* each constituting a circulation channel 53. The longitudinal direction of the through grooves 53*a* is coincident with the nozzle array direction.

Figure 7D:
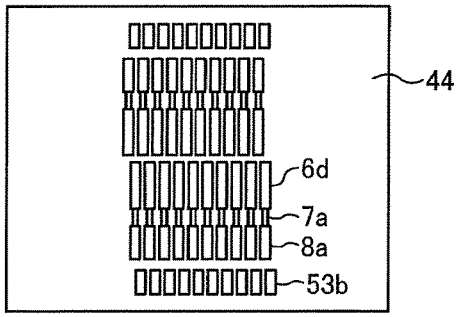

As illustrated in FIG. 7D, the plate-like member 44 includes through grooves 6*d* each constituting the individual liquid chamber 6, through grooves 7*a* each constituting the fluid resistance part 7, through grooves 8*a* each constituting the liquid introduction part 8, and through grooves 53*b* each constituting the circulation channel 53. The longitudinal direction of the through grooves 53*b* is coincident with the nozzle array direction.

Figure 7E:
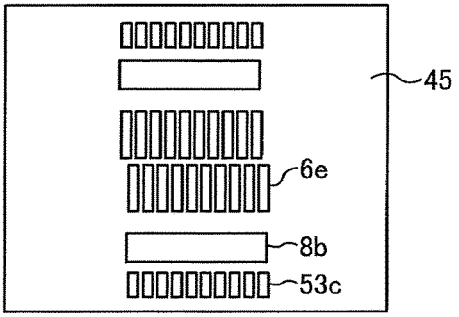

As illustrated in FIG. 7E, the plate-like member 45 includes through grooves 6*e* each constituting the individual liquid chamber 6, a through groove 8*b* (serving as a liquid chamber disposed downstream of the filter) constituting the liquid introduction part 8, and through grooves 53*c* each constituting the circulation channel 53. The longitudinal direction of both the through groove 8*b* and the through grooves 53*c* is coincident with the nozzle array direction.

Figure 7F:
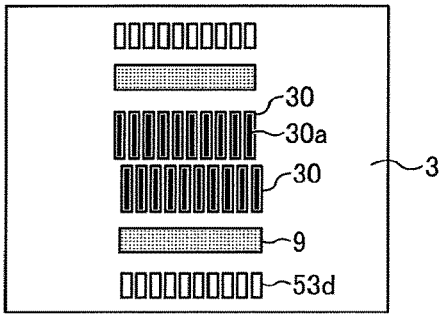

As illustrated in FIG. 7F, the diaphragm 3 includes the vibration areas 30, the filter part 9, and through grooves 53*d* each constituting the circulation channel 53. The longitudinal direction of the through grooves 53*d* is coincident with the nozzle array direction.

As a consequence, a complicate channel can be formed by a simple configuration in which multiple plate-like members are attached to each other in a lamination manner.

According to the configuration described above, in the channel substrate 40 formed of the channel plate 2 and the diaphragm 3, the fluid resistance part 51, the circulation channel 52, and the circulation channel 53 are formed. Specifically, the fluid resistance part 51 is formed along the plane direction of the channel plate 2 in communication with the individual liquid chamber 6. The circulation channel 53 is formed in the thickness direction of the channel substrate 40 in communication with the circulation channel 52. The circulation channel 53 is in communication with a circulation common liquid chamber 50 to be described later.

The common liquid chamber substrate 20 forms the common liquid chamber 10, to which the liquid is supplied from a supply-circulation mechanism 494 (to be described later), and the circulation common liquid chamber 50.

The common liquid chamber substrate 20 includes a first common liquid chamber substrate 21 and a second common liquid chamber substrate 22. As illustrated in FIG. 8A, the first common liquid chamber substrate 21 includes a through hole 25*a* for the piezoelectric actuator 11, a through groove 10*a* serving as a downstream common liquid chamber 10A disposed on the downstream side, and a groove 50*a* (having the bottom) serving as the circulation common liquid chamber 50.

As illustrated in FIG. 8B, the second common liquid chamber substrate 22 includes a through hole 25*b* for the piezoelectric actuator 11 and a groove 10*b* serving as an upstream common liquid chamber 10B disposed on the upstream side.

The second common liquid chamber substrate 22 further includes a through hole 71*a* to communicate one end of the common liquid chamber 10 in the nozzle array direction with a supply port 71 illustrated in FIG. 3.

Similarly, the first common liquid chamber substrate 21 and the second common liquid chamber substrate 22 include a through hole 81*a* and a through hole 81*b*, respectively, to communicate the other end (the opposite end on the side of the through hole 71*a*) of the circulation common liquid chamber 50 in the nozzle array direction with a circulation port 81.

In FIGS. 8A and 8B, the grooves having the bottom are hatched. (The same applies to other drawings.)

The common liquid chamber substrate 20 includes the first common liquid chamber substrate 21 and the second common liquid chamber substrate 22, as described above. The first common liquid chamber substrate 21 is attached to the channel substrate 40 on the diaphragm 3 side and the second common liquid chamber substrate 22 is attached to and laminated on the first common liquid chamber substrate 21.

The first common liquid chamber substrate 21 forms the downstream common liquid chamber 10A, constituting a part of the common liquid chamber 10 in communication with the liquid introduction part 8, and the circulation common liquid chamber 50 in communication with the circulation channel 53. The second common liquid chamber substrate 22 forms the upstream common liquid chamber 10B constituting the rest of the common liquid chamber 10.

The downstream common liquid chamber 10A constituting a part of the common liquid chamber 10 and the circulation common liquid chamber 50 are disposed next to each other in a direction perpendicular to the nozzle array direction. The circulation common liquid chamber 50 is disposed at the position projected in the common liquid chamber 10.

By this disposition, the dimension of the circulation common liquid chamber 50 is free of the restriction ascribable to the dimensions required for the individual liquid chamber 6, the fluid resistance part 7, and the liquid introduction part 8 formed in the channel substrate 40.

Since the circulation common liquid chamber 50 and a part of the common liquid chamber 10 are disposed side by side and the circulation common liquid chamber 50 is located at the position projected in the common liquid chamber 10, the width of the head in a direction perpendicular to the nozzle array direction is restricted, thereby preventing size increase of the head. The common liquid chamber substrate 20 forms the common liquid chamber 10, to which a liquid is supplied from a head tank or a liquid cartridge, and the circulation common liquid chamber 50.

On the other side of the diaphragm 3 opposite to the individual liquid chamber 6, the piezoelectric actuator 11 is disposed. The piezoelectric actuator 11 includes an electromechanical transducer element serving as a driver that deforms the vibration area 30 of the diaphragm 3.

As illustrated in FIG. 5, this piezoelectric actuator 11 includes a piezoelectric member 12 attached to a base material 13. The piezoelectric member 12 is grooved by half cut dicing and a particular number of piezoelectric elements (piezoelectric pillars) 12A and 12B each having a pillar-like form are formed in the piezoelectric member 12 spaced a predetermined distance therebetween in a pectinate manner.

In the present embodiment, the piezoelectric element 12A is driven by application of a drive waveform while the piezoelectric element 12B is not driven but simply used as a pillar. Alternatively, all of the piezoelectric elements 12A and 12B can be used as the piezoelectric element to be driven by application of drive waveforms.

The piezoelectric element 12A is attached to a convex portion 30*a* that is a thick portion having an island-like form formed on the vibration area 30 of the diaphragm 3. The piezoelectric element 12B is attached to a convex portion 30*b* that is a thick portion of the diaphragm 3.

The piezoelectric member 12 includes piezoelectric layers and internal electrodes alternately laminated on each other. Each internal electrode is pulled out to the end surface to form an external electrode. The external electrode is connected with a flexible wiring member 15.

In the circulation-type discharge head having such a configuration, the piezoelectric element 12A is contracted by lowering the voltage applied to the piezoelectric element 12A in comparison with a reference voltage. As a result, the vibration area 30 of the diaphragm 3 is lowered and the individual liquid chamber 6 is inflated, thereby letting the liquid flow into the individual liquid chamber 6.

The piezoelectric element 12A is thereafter expanded in the lamination direction by raising the voltage applied to the piezoelectric element 12A. Thus, the vibration area 30 of the diaphragm 3 is deformed toward the nozzle 4 and the individual liquid chamber 6 is contracted. As a result, the liquid in the individual liquid chamber 6 is pressurized and discharged from the nozzle 4.

The voltage applied to the piezoelectric element 12A is thereafter returned to the reference voltage to restore the vibration area 30 of the diaphragm 3 to the initial position. As a result, the individual liquid chamber 6 is inflated to generate a negative pressure, and the liquid is supplied from the common liquid chamber 10 to the individual liquid chamber 6. After the vibration of the meniscus surface of the nozzle 4 has attenuated and stabilized, the operation transits to next discharge procedure.

The drive method of the head is not limited to the above-described method (i.e., pull-push discharging). The way of discharging changes depending on how a drive waveform is applied. For example, pull discharging or push discharging is possible. In addition, in the embodiments described above, a lamination-type piezoelectric element is used as a pressure generator to cause pressure fluctuation to the individual liquid chamber 6, but the pressure generator is not limited thereto. It is possible to use a piezoelectric element having a thin-film like form. Furthermore, it is possible to dispose a heat element in the individual liquid chamber 6 to form bubbles by heat, thereby generating pressure fluctuation, or to utilize electrostatic force to cause pressure fluctuation.

Next, one example of a liquid circulation system using the circulation-type discharge head is described with reference to FIG. 9.

Figure 9:
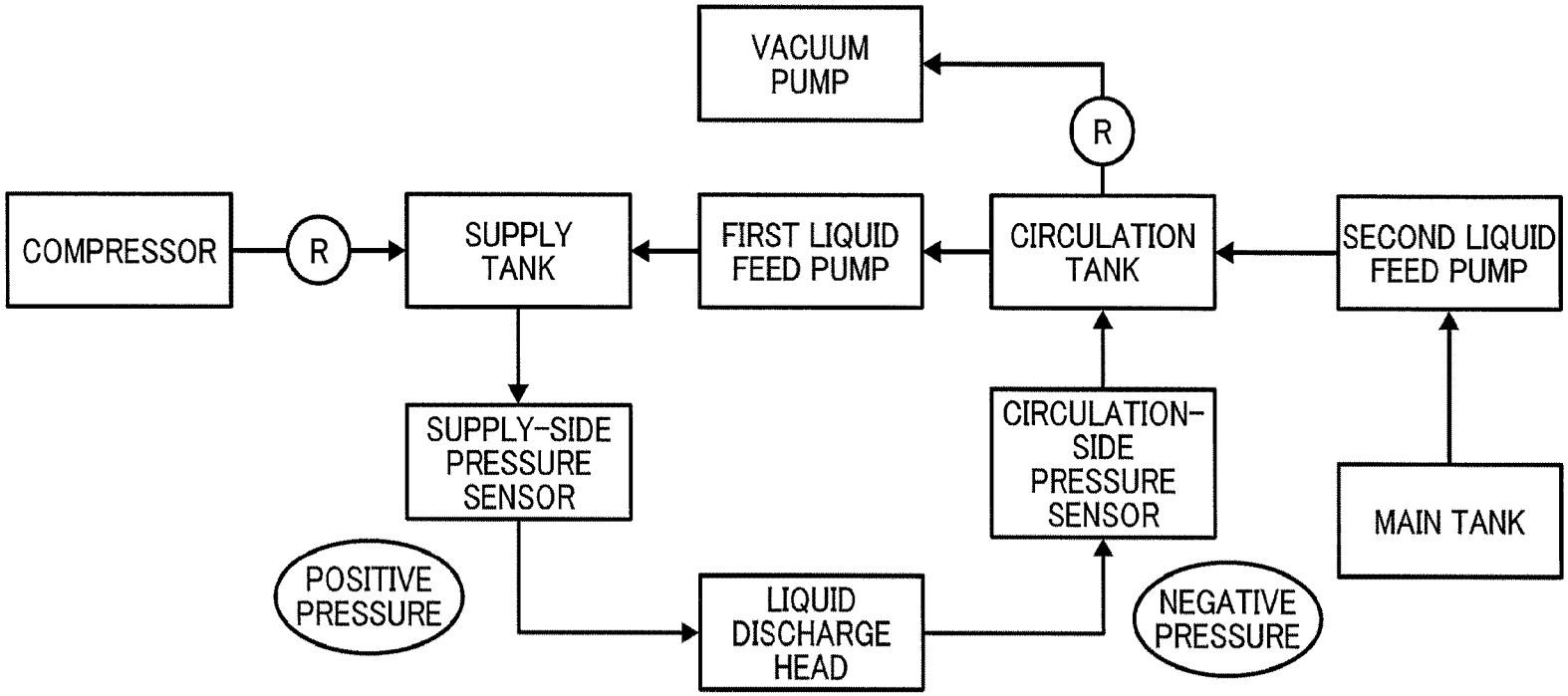
FIG. 9 is a block diagram of a liquid circulation system in accordance with some embodiments of the present invention.

FIG. 9 is a block diagram of a liquid circulation system.

As illustrated in FIG. 9, the liquid circulation system includes a main tank, a liquid discharge head, a supply tank, a circulation tank, a compressor, a vacuum pump, a first liquid feed pump, a second liquid feed pump, regulators (R), a supply-side pressure sensor, and a circulation-side pressure sensor. The supply-side pressure sensor is disposed between the supply tank and the liquid discharge head and connected with the supply channel side of the liquid discharge head connected with the supply port 71 (illustrated in FIG. 3). The circulation-side pressure sensor is disposed between the liquid discharge head and the circulation tank and connected with the circulation channel side of the liquid discharge head connected with the circulation port 81 (illustrated in FIG. 3).

One end of the circulation tank is connected with the supply tank via the first liquid feed pump and the other end thereof is connected with the main tank via the second liquid feed pump. The liquid flows from the supply tank into the liquid discharge head via the supply port 71, and is discharged to the circulation tank via the circulation port 81. The liquid is further fed from the circulation tank to the supply tank by the first liquid feed pump, thus circulating the liquid.

The compressor is connected with the supply tank to control such that the supply-side pressure sensor detects a predetermined positive pressure. The vacuum pump is connected with the circulation tank to control such that the circulation-side pressure sensor detects a predetermined negative pressure. Accordingly, while the liquid is circulated through the liquid discharge head, the negative pressure of the meniscus can be kept constant.

In addition, as liquid droplets are discharged from the nozzle of the circulation-type discharge head, the amount of the liquid in the supply tank and the circulation tank decreases. Therefore, it is preferable to properly supply the liquid from the main tank to the circulation tank with the second liquid feed pump. The timing of the liquid supply from the main tank to the circulation tank can be controlled according to the detection result of the liquid surface sensor disposed in the circulation tank. For example, the liquid can be supplied when the liquid surface of the ink in the circulation tank is lowered in comparison with the predetermined height.

Figure 10:
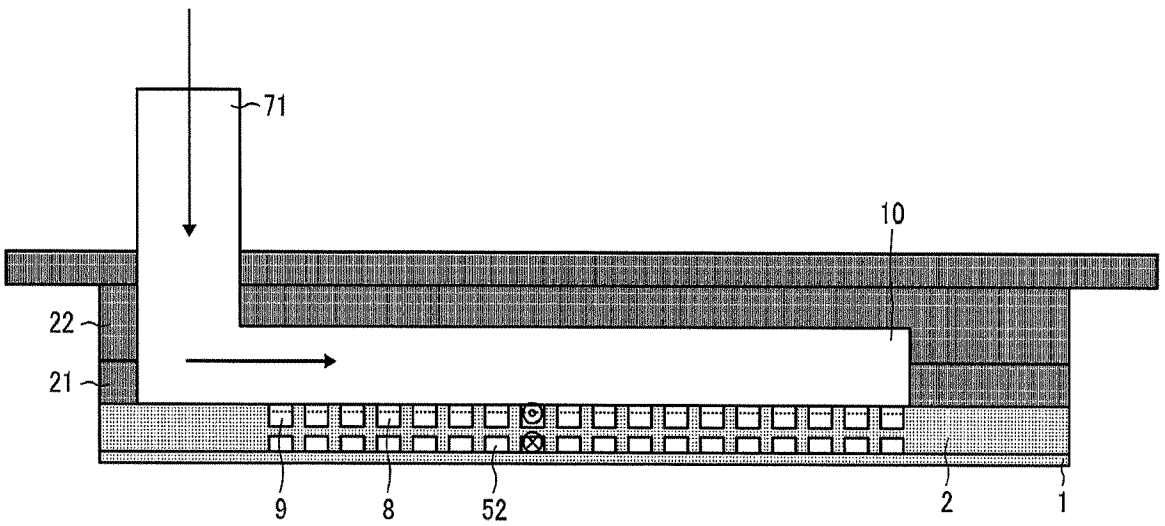
FIG. 10 is a cross-sectional view taken along the line A-A' in FIG. 4.

Next, circulation of the liquid in the circulation-type discharge head is described below. As illustrated in FIG. 3, the supply port 71 communicating with the common liquid chamber 10 and the circulation port 81 communicating with the circulation common liquid chamber 50 are formed on one end of the common liquid chamber substrate 20. The supply port 71 and the circulation port 81 are respectively connected with the supply tank and the circulation tank (illustrated in FIG. 9), for storing liquid, via tubes. The liquid stored in the supply tank is supplied to the individual liquid chamber 6 via the supply port 71, the common liquid chamber 10, the liquid introduction part 8, and the fluid resistance part 7 (as illustrated in FIG. 10).

Figure 11:
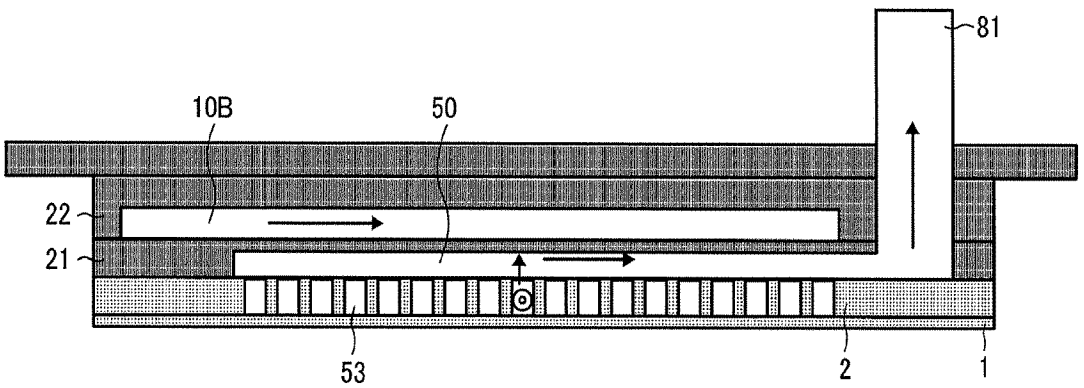
FIG. 11 is a cross-sectional view taken along the line B-B' in FIG. 4.

Moreover, while the liquid in the individual liquid chamber 6 is discharged from the nozzle 4 due to drive of the piezoelectric member 12, a part or the entire of the liquid remaining in the individual liquid chamber 6 without being discharged is circulated toward the circulation tank via the fluid resistance part 51, the circulation channels 52 and 53, the circulation common liquid chamber 50, and the circulation port 81 (as illustrated in FIG. 11). The liquid can be circulated regardless of whether the circulation-type discharge head is in operation or not. Circulating the liquid during waiting time is preferable because the liquid in the individual liquid chamber is constantly refreshed and agglomeration or sedimentation of the component contained in the liquid can be suppressed.

Figure 12:
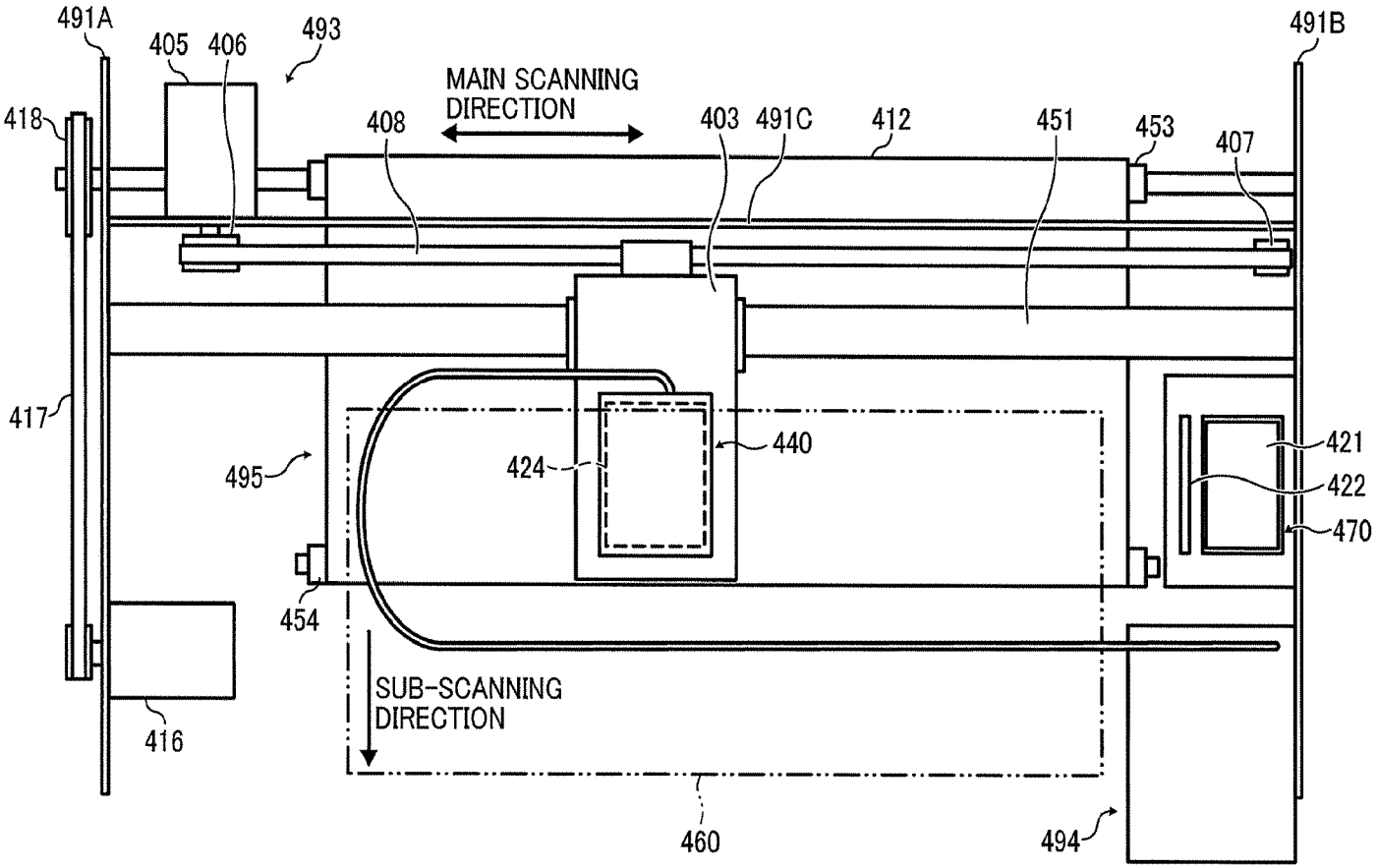
FIG. 12 is a plan view of a major part of an ink discharge device in accordance with some embodiments of the present invention.
Figure 13:
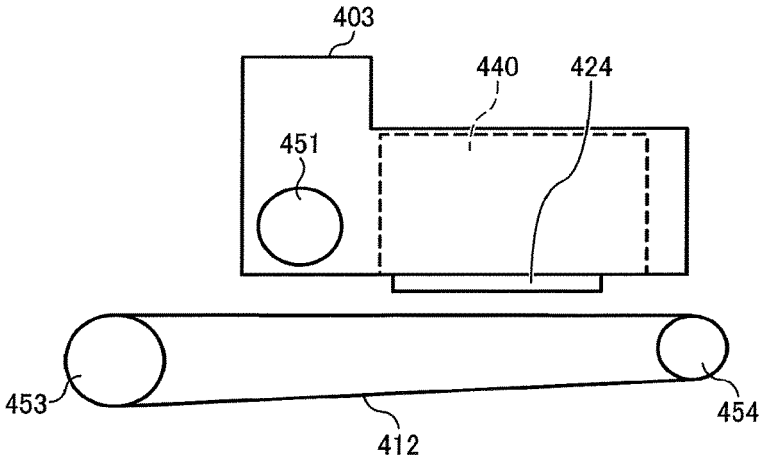
FIG. 13 is a side view of a major part of the ink discharge device illustrated in FIG. 12.

One example of a liquid discharge device using the circulation type discharge head is described below with reference to FIGS. 12 and 13. FIG. 12 is a plan view of a major part of the liquid discharge device. FIG. 13 is a side view of a major part of the liquid discharge device.

This device is a serial-type device in which a main scanning moving mechanism 493 reciprocates a carriage 403 in the main scanning direction. The main scanning moving mechanism 493 includes a guide member 451, a main scanning motor 405, and a timing belt 408. The guide member 451 is bridged between the left and right side plates 491A and 491B to moveably hold the carriage 403. The main scanning motor 405 reciprocates the carriage 403 in the main scanning direction via the timing belt 408 bridged between a drive pulley 406 and a driven pulley 407.

The carriage 403 carries a liquid discharge unit 440 carrying a liquid discharge head 424. The liquid discharge head 424 of the liquid discharge unit 440 discharges color liquids of, for example, yellow (Y), cyan (C), magenta (M), and black (K). The liquid discharge head 424 has nozzle arrays each including multiple nozzles arranged in the sub-scanning direction that is perpendicular to the main scanning direction. The liquid discharge head 424 is mounted on the liquid discharge unit 440 with its discharging surface facing downward.

A liquid stored outside the liquid discharge head 424 is supplied to and circulated in the liquid discharge head 424 by a supply-circulation mechanism 494. The supply-circulation mechanism 494 includes a supply tank, a circulation tank, a compressor, a vacuum pump, a liquid feed pump, and a regulator (R). A supply-side pressure sensor is disposed between the supply tank and the liquid discharge head and connected with the supply channel side of the liquid discharge head connected with the supply port 71. A circulation-side pressure sensor is disposed between the liquid discharge head and the circulation tank and connected with the circulation channel side of the liquid discharging head connected with the circulation port 81.

This device further includes a conveyance mechanism 495 to convey a recording medium 460. The conveyance mechanism 495 includes a conveyance belt 412 serving as a conveyer and a sub-scanning motor 416 to drive the conveyance belt 412.

The conveyance belt 412 adsorbs the recording medium 460 and conveys it to the position facing the liquid discharge head 424. The conveyance belt 412 is in the form of an endless belt stretched between a conveyance roller 453 and a tension roller 454. The conveyance belt 412 adsorbs the recording medium 460 by electrostatic adsorption or suction.

The conveyance belt 412 moves around in the sub-scanning direction as the conveyance roller 453 is rotationally driven by the sub-scanning motor 416 via a timing belt 417 and a timing pulley 418.

On one side of the carriage 403 in the main scanning direction, a maintenance mechanism 470 for maintaining the liquid discharge head 424 is disposed lateral to the conveyance belt 412.

The maintenance mechanism 470 includes a capping member 421 to cap a nozzle surface (surface on which the nozzle is formed) of the liquid discharge head 424 and a wiping member 422 to wipe off the nozzle surface.

The main scanning moving mechanism 493, the supply-circulation mechanism 494, the maintenance mechanism 470, and the conveyance mechanism 495 are installed onto a housing including the side plates 491A and 491B and a back plate 491C.

In this device having such a configuration, the recording medium 460 is fed and adsorbed onto the conveyance belt 412 and conveyed along the sub-scanning direction by the rotational movement of the conveyance belt 412.

By driving the liquid discharge head 424 in response to an image signal while moving the carriage 403 in the main-scanning direction, the liquid is discharged onto the recording medium 460 not in motion to record an image.

Since the circulation-type discharge head is provided in this device, high quality images can be stably formed.

Figure 14:
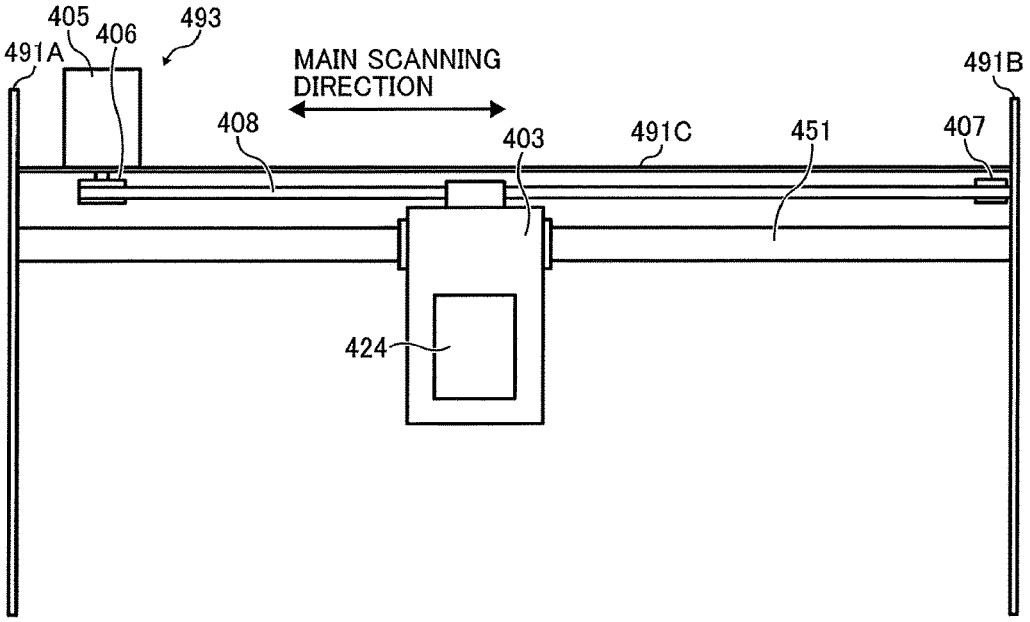
FIG. 14 is a plan view of a major part of an ink discharge unit in accordance with some embodiments of the present invention.

Next, a liquid discharge unit is described with reference to FIG. 14 as another example. FIG. 14 is a plan view of a major part of the liquid discharge unit.

This liquid discharge unit is constituted of the housing portion including the side plates 491A and 491B and the back plate 491C, the main scanning moving mechanism 493, the carriage 403, and the liquid discharge head 424, which are the same members constituting the above-described liquid discharge device.

Optionally, the liquid discharge unit can be constituted in such a manner that at least one of the maintenance mechanism 470 and the supply-circulation mechanism 494 is further attached to, for example, the side plate 491B.

In the present disclosure, a "liquid discharge head" refers to a functional part configured to discharge or eject liquid from a nozzle.

The liquid to be discharged is not limited to any particular substance so long as the viscosity and surface tension thereof do not prevent the liquid itself from being discharged from the head. In particular, liquids expressing a viscosity of 30 mPa·s or less under normal temperature and normal pressure, or by heating or cooling, are preferable. Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and three-dimensional object forming material liquids.

As energy sources for discharging the liquid, piezoelectric actuators (e.g., laminated piezoelectric elements, thin-film piezoelectric elements), thermal actuators using electrothermal conversion elements such as heat elements, and electrostatic actuators formed of a vibration plate and a counter electrode may be used.

In the present disclosure, a "liquid discharge unit" refers to a liquid discharge head integrated with functional components/mechanisms, i.e., an aggregation of components related to liquid discharge. For example, the liquid discharge unit may include a combination of a liquid discharge head with at least one of a supply-circulation mechanism, a carriage, a maintenance mechanism, and a main scanning moving mechanism.

When it is stated that a liquid discharge head and functional components/mechanisms are integrated with each other, it refers to a case in which the liquid discharge head and the functional components/mechanisms are secured to each other by means of fastening, bonding, or engaging, or another case in which one of the liquid discharge head and the functional components/mechanisms is movably supported by the other one of them. In addition, it also refers to a case in which the liquid discharge head and the functional components/mechanisms are detachably attached to each other.

Examples of the liquid discharge unit further include a liquid discharge head integrated with a supply-circulation mechanism. In this case, the liquid discharge head and the supply-circulation mechanism may be connected to each other with a tube. Furthermore, a filter unit may be disposed between the supply-circulation mechanism and the liquid discharge head.

Examples of the liquid discharge unit further include a liquid discharge head integrated with a carriage.

Examples of the liquid discharge unit further include a liquid discharge unit integrated with a scanning moving mechanism in such a manner that the liquid discharge head is movably supported by a guide member that constitutes a part of the scanning moving mechanism.

Examples of the liquid discharge unit further include a liquid discharge head integrated with a carriage and a maintenance mechanism in such a manner that the liquid discharge head is mounted on the carriage and a cap member of the maintenance mechanism is secured to the carriage.

Examples of the liquid discharge unit further include a liquid discharge head integrated with a supply mechanism in such a manner that a supply-circulation mechanism or a flow path member is mounted on the liquid discharge head and a tube is connected to the liquid discharge head. The liquid stored in a liquid container is supplied to the liquid discharge head via the tube.

Examples of the main scanning moving mechanism include a single guide member. Examples of the supply mechanism include a single tube or a single loading port.

In the present disclosure, a "liquid discharge device" refers to a device including a liquid discharge head or a liquid discharge unit, configured to discharge a liquid by driving the liquid discharge head. Examples of the liquid discharge device include a device capable of discharging a liquid to a substance to which the liquid is adherable and another device capable of discharging a liquid toward a gas or into a liquid.

The liquid discharge device may further optionally include units relating to feeding, conveying, or ejecting of the substance to which the liquid is adherable, a pretreatment unit, and/or an aftertreatment unit.

Specific examples of the liquid discharge device include an image forming apparatus configured to discharge an ink onto a sheet to form an image thereon, and a three-dimensional object forming apparatus configured to discharge an object forming liquid onto a powder lamination layer to form a three-dimensional object.

In addition, the liquid discharge device is not limited to those producing merely meaningful visible images such as texts and figures with the discharged liquid. For example, the liquid discharge device can produce patterns like geometric design and three-dimensional images.

The above-described "substance to which a liquid is adherable" refers to a substance to which a liquid is at least temporarily adherable, allowing the liquid either to fix thereon or to permeate after the adhesion. Specific examples of such substances include, but are not limited to, recording media (e.g., paper sheet, recording sheet, film, clothe), electronic components (e.g., electronic substrate, piezoelectric element), powder layers, organ models, and test cells.

The substance to which a liquid is adherable may be made of any material to which a liquid is at least temporarily adherable, such as paper, thread, fiber, cloth, laser, metal, plastic, glass, wood, and ceramic.

The liquid is not limited to any particular substance so long as the viscosity and surface tension thereof do not prevent the liquid itself from being discharged from the head. In particular, liquids expressing a viscosity of 30 mPa·s or less under normal temperature and normal pressure, or by heating or cooling, are preferable. Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and three-dimensional object forming material liquids.

Examples of the liquid discharge device further include a device in which a liquid discharge head and a substance to which a liquid is adherable are movable relative to each other, but are not limited thereto. Specific examples of such a device include a serial-type device in which a liquid discharge head is movable and a line-type apparatus in which a liquid discharge head is unmovable.

Examples of the liquid discharge device further include: a treatment liquid applying device that discharges a treatment liquid onto a paper sheet to apply the treatment liquid to the surface of the paper sheet, for reforming the surface of the paper sheet; and an injection granulation device that injects a composition liquid, in which a raw material is dispersed in a solution, through a nozzle to granulate fine particle of the raw material.

In the present disclosure, "image forming", "recording", "printing", "object forming", and the like, are treated as synonymous terms.

The recording device according to an embodiment of the present invention may further optionally include a pretreatment device and/or an aftertreatment device, in addition to the ink discharger.

As an example, the pretreatment device and the aftertreatment device may be provided as a liquid discharger including a liquid container containing the pretreatment or aftertreatment liquid and a liquid discharge head to discharge the pretreatment or aftertreatment liquid by inkjet recording method, having a similar configuration to the liquid discharger for each of the black (K), cyan (C), magenta (M), and yellow (Y) inks.

As another example, the pretreatment device and the aftertreatment device may be provided as a device employing a method other than inkjet recording method, such as blade coating, roll coating, or spray coating.

EXAMPLES

Further understanding can be obtained by reference to certain specific examples which are provided herein for the purpose of illustration only and are not intended to be limiting.

Preparation Example 1

Preparation of Surface-Modified Black Pigment Dispersion 1

First, 100 g of BLACK PEARLS (trademark) 1000 available from Cabot Corporation (i.e., a carbon black having a BET specific surface area of 343 $m^2/g$ and a DBPA of 105 mL/100 g), 100 mmol of sulfanilic acid, and 1 L of ion-exchange high-purity water were mixed by a Silverson mixer at a revolution of 6,000 rpm at room temperature.

In a case in which the pH of the resulting slurry was higher than 4, 100 mmol of nitric acid was added thereto. Thirty minutes later, 100 mmol of sodium nitrite dissolved in a small amount of ion-exchange high-purity water was gently added to the mixture. The mixture was heated to 60° C. while being stirred and subjected to a reaction for 1 hour. As a result, a modified pigment was produced in which sulfanilic acid group was added to the carbon black.

Next, a 10% by mass methanol solution of tetrabutylammonium hydroxide was added to the mixture to adjust the pH to 9. As a result, a modified pigment dispersion was obtained 30 minutes later.

The modified pigment dispersion, containing the pigment bonded to at least one of sulfanilic acid group and sulfanilic acid tetrabutylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The surface treatment level of the modified pigment dispersion was 0.75 mmol/g. The volume average particle diameter was 120 nm when measured by a particle size distribution analyzer (NANOTRAC UPA-EX150 available from Nikkiso Co., Ltd.).

Preparation Example 2

Preparation of Surface-Modified Black Pigment Dispersion 2

A Process All 4HV Mixer (4 L) was filled with 500 g of BLACK PEARLS (trademark) 880 available from Cabot Corporation (i.e., a carbon black having a BET specific surface area of 220 $m^2/g$ and a DBPA of 105 mL/100 g), 1 L of ion-exchange high-purity water, and 175 mmol of 4-aminobenzoic acid.

The mixture was strongly mixed for 10 minutes at a revolution of 300 rpm while being heated to 60° C. A 20% by mass aqueous solution of sodium nitrite (175-mmol equivalent based on 4-aminobenzoic acid) was added to the mixture over a period of 15 minutes. The mixture was stirred for 3 hours while being heated to 60° C. The reaction product was taken out while being diluted with 750 mL of ion-exchange high-purity water.

Next, a 10% by mass aqueous solution of tetraethylammonium hydroxide was added to the mixture to adjust the pH to 9. As a result, a modified pigment dispersion was obtained 30 minutes later.

The modified pigment dispersion, containing the pigment bonded to at least one of aminobenzoic acid group and aminobenzoic acid tetraethylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The surface treatment level of the modified pigment dispersion was 0.35 mmol/g. The volume average particle diameter was 114 nm when measured by a particle size distribution analyzer (NANOTRAC UPA-EX150 available from Nikkiso Co., Ltd.).

Preparation Example 3

Preparation of Surface-Modified Black Pigment Dispersion 3

First, 0.1N HCl aqueous solution was added to 1 kg of a dispersion of a self-dispersible carbon black (i.e., Aqua-Black 162 available from TOKAI CARBON CO., LTD., having a solid pigment concentration of 19.2% by mass) to precipitate the pigment. Next, a 40% by mass methanol solution of benzyltrimethylammonium hydroxide was added to the mixture to adjust the pH to 9. As a result, a modified pigment dispersion was obtained 30 minutes later.

The modified pigment dispersion, containing the pigment bonded to at least one of carboxylic acid group and carboxylic acid benzyltrimethylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The volume average particle diameter of the modified pigment dispersion was 100 nm when measured by a particle size distribution analyzer (NANOTRAC UPA-EX150 available from Nikkiso Co., Ltd.).

Preparation Example 4

Preparation of Surface-Modified Magenta Pigment Dispersion 1

First, 0.1N HCl aqueous solution was added to 1 kg of a dispersion of a magenta pigment (i.e., SENSIJET SMART Magenta 3122BA available from Sensient Technologies Corporation, a dispersion of surface-treated Pigment Red 122, having a solid pigment concentration of 14.5% by mass) to precipitate the pigment. Next, a 10% by mass aqueous solution of tetraethylammonium hydroxide was added to the mixture to adjust the pH to 9. As a result, a modified pigment dispersion was obtained 30 minutes later.

The modified pigment dispersion, containing the pigment bonded to at least one of aminobenzoic acid group and aminobenzoic acid tetraethylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The volume average particle diameter of the modified pigment dispersion was 104 nm when measured by a particle size distribution analyzer (NANOTRAC UPA-EX150 available from Nikkiso Co., Ltd.).

Preparation Example 5

Preparation of Surface-Modified Cyan Pigment Dispersion 1

First, 0.1N HCl aqueous solution was added to 1 kg of a dispersion of a cyan pigment (i.e., SENSIJET SMART Cyan 3154BA available from Sensient Technologies Corporation, a dispersion of surface-treated Pigment Blue 15:4, having a solid pigment concentration of 14.5% by mass) to precipitate the pigment. Next, a 40% by mass methanol solution of benzyltrimethylammonium hydroxide was added to the mixture to adjust the pH to 9. As a result, a modified pigment dispersion was obtained 30 minutes later.

The modified pigment dispersion, containing the pigment bonded to at least one of aminobenzoic acid group and aminobenzoic acid benzyltrimethylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The volume average particle diameter of the modified pigment dispersion was 116 nm when measured by a particle size distribution analyzer (NANOTRAC UPA-EX150 available from Nikkiso Co., Ltd.).

Preparation Example 6

Preparation of Surface-Modified Yellow Pigment Dispersion 1

First, 0.1N HCl aqueous solution was added to 1 kg of a dispersion of a yellow pigment (i.e., SENSIJET SMART Yellow 3074BA available from Sensient Technologies Corporation, a dispersion of surface-treated Pigment Yellow 74, having a solid pigment concentration of 14.5% by mass) to precipitate the pigment. Next, a 10% by mass methanol solution of tetrabutylammonium hydroxide was added to the mixture to adjust the pH to 9. As a result, a modified pigment dispersion was obtained 30 minutes later.

The modified pigment dispersion, containing the pigment bonded to at least one of aminobenzoic acid group and aminobenzoic acid tetrabutylammonium salt, was subjected to ultrafiltration using ion-exchange high-purity water and a dialysis membrane and thereafter to ultrasonic dispersion. As a result, the modified pigment dispersion was obtained in which solid contents had been condensed to 20% by mass.

The volume average particle diameter of the modified pigment dispersion was 145 nm when measured by a particle size distribution analyzer (NANOTRAC UPA-EX150 available from Nikkiso Co., Ltd.).

Production Example 1

Preparation of Acrylic-Silicone Polymer Particle Dispersion

After sufficiently replacing the air in a 1-L flask equipped with a mechanical stirrer, a thermometer, a nitrogen gas inlet pipe, a reflux pipe, and a dropping funnel with nitrogen gas, 8.0 g of a reactive nonionic surfactant (LATEMUL S-180 available from Kao Corporation) and 350 g of ion-exchange water were mixed in the flask and the temperature was raised to 65° C. After the temperature rising, 3.0 g of t-butyl peroxybenzoate (serving as a reaction initiator) and 1.0 g of sodium isoascorbate were added to the flask. Five minutes later, a mixture of 45 g of methyl methacrylate, 160 g of 2-ethylhexyl methacrylate, 5 g of acrylic acid, 45 g of butyl methacrylate, 30 g of cyclohexyl methacrylate, 15 g of vinyl triethoxysilane, 8.0 g of a reactive nonionic surfactant (LATEMUL S-180 available from Kao Corporation), and 340 g of ion-exchange water was dropped in the flask over a period of 3 hours.

The flask contents were aged at 80° C. for 2 hours and cooled to normal temperature. The pH thereof was adjusted to 7 to 8 using sodium hydroxide.

Ethanol was removed with an evaporator, and the moisture content was controlled. Thus, 730 g of a polymer particle dispersion having a solid content concentration of 40% by mass was prepared.

The volume average particle diameter of the polymer particle dispersion was 125 nm when measured by a particle size distribution analyzer (NANOTRAC UPA-EX150 available from Nikkiso Co., Ltd.).

Ink Production Example 1

Preparation of Ink 1

In a vessel equipped with a stirrer, 20.00% by mass of 3-n-butoxy-N,N-dimethylpropanamide having the formula (1), 25.00% by mass of 1,2-propanediol, 2.00% by mass of 2,2,4-trimethyl-1,3-pentanediol, 1.00% by mass of a polyether-modified siloxane compound having the formula (VII), and 0.50% by mass of 2,4,7,9-tetramethyldecane-4,7-diol (as a foam inhibitor) were uniformly stirred for 30 minutes.

Next, 0.05% by mass of a fungicide (i.e., PROXEL GXL available from AVECIA GROUP), 0.20% by mass of 2-amino-2-ethyl-1,3-propanediol (as a pH adjuster), 37.50% by mass of the surface-modified black pigment dispersion 1 prepared in Preparation Example 1, and pure water in an amount such that the total amount became 100% by mass were added to the vessel, and the vessel contents were stirred for 60 minutes.

The resulting mixture was subjected to pressure filtration using a polyvinylidene fluoride membrane filter having an average pore diameter of 1.2 μm to remove coarse particles and foreign substances. Thus, an ink 1 was prepared.

Ink Production Example 2

Preparation of Ink 2

In a vessel equipped with a stirrer, 42.00% by mass of 3-ethyl-3-hydroxymethyloxetane having the formula (4), 2.00% by mass of 2-ethyl-1,3-hexanediol, 2.00% by mass of a polyether-modified siloxane compound (i.e., TEGO Wet 270 available from Evonik Japan Co., Ltd., containing 100% by mass of active ingredients), and 0.4% by mass of 2,5,8,11-tetramethyldecane-5,8-diol (as a foam inhibitor) were uniformly stirred for 30 minutes.

Next, 0.05% by mass of a fungicide (i.e., PROXEL GXL available from AVECIA GROUP), 0.10% by mass of 2-amino-2-ethyl-1,3-propanediol (as a pH adjuster), 35.0% by mass of the surface-modified black pigment dispersion 2 prepared in Preparation Example 2, and pure water in an amount such that the total amount became 95% by mass were added to the vessel, and the vessel contents were stirred for 60 minutes.

Further, 5.00% by mass of the acrylic-silicone polymer particle dispersion prepared in Production Example 1 was added to the vessel, so that the total amount became 100% by mass, and the vessel contents were stirred for 30 minutes.

The resulting mixture was subjected to pressure filtration using a polyvinylidene fluoride membrane filter having an average pore diameter of 1.2 μm to remove coarse particles and foreign substances. Thus, an ink 2 was prepared.

Ink Production Examples 3 to 12

Preparation of Inks 3 to 12

Inks 3 to 12 were prepared in the same manner as Ink 1 or 2 except for changing each composition according to Tables 1 to 3.

TABLE 1

| | | Components (% by mass) | Ink No. 1 | 2 | 3 | 4 | 5 |
|---|---|---|---|---|---|---|---|
| | Water-dispersible colorants (Pigment dispersions) | Surface-modified black pigment dispersion 1 (Preparation Example 1) | 37.50 | — | — | — | — |
| | | Surface-modified black pigment dispersion 2 (Preparation Example 2) | — | 35.00 | — | — | — |
| | | Surface-modified black pigment dispersion 3 (Preparation Example 3) | — | — | 37.50 | — | — |
| | | Surface-modified magenta pigment dispersion 1 (Preparation Example 4) | — | — | — | 35.00 | — |
| | | Surface-modified cyan pigment dispersion 1 (Preparation Example 5) | — | — | — | — | — |
| | | Surface-modified yellow pigment dispersion 1 (Preparation Example 6) | — | — | — | — | 22.50 |
| | Water-dispersible resin | Acrylic-silicone polymer particle dispersion | — | 5.00 | 5.00 | 5.00 | 5.00 |
| | Wax | AQ515: Polyethylene wax | — | — | — | — | — |
| Organic Solvents | Organic Solvents | Formula (1): 3-n-Butoxy-N,N-dimethylpropanamide (SP = 9.03) | 20.00 | — | — | — | — |
| | | Formula (4): 3-Ethyl-3-hydroxymethyloxetane (SP = 11.3) | — | 42.00 | 30.00 | 39.00 | 52.50 |
| | | 1,2-Butanediol (SP = 12.8) | — | — | 5.00 | — | — |
| | | 1,2-Propanediol (SP = 13.5) | 25.00 | — | 5.00 | — | — |
| | Penetrant | 2-Ethyl-1,3-hexanediol (SP = 10.6) | — | 2.00 | 2.00 | 2.00 | 2.00 |
| | | 2,2,4-Trimethyl-1,3-pentanediol (SP = 10.8) | 2.00 | — | — | — | — |
| | Surfactants | Formula (VII'): Polyether-modified siloxane compound | 1.00 | — | — | 2.00 | — |
| | | Formula (IX) Polyether-modified siloxane compound | — | — | — | — | — |
| | | Formula (X): Polyether-modified siloxane compound | — | — | — | — | 3.00 |
| | | TEGO Wet 270 | — | 2.00 | — | — | — |
| | | SILFACE SAG503A | — | — | 1.00 | — | — |
| | | SURFYNOL 104E | — | — | — | — | — |
| | | SOFTANOL EP-7025 | — | — | — | — | — |
| | Fungicide | PROXEL GXL | 0.05 | 0.05 | 0.05 | 0.05 | 0.05 |
| | Foam inhibitor (Defoamer) | 2,4,7,9-Tetramethyldecane-4,7-diol | 0.50 | — | 0.40 | 0.40 | 0.40 |
| | | 2,5,8,11-Tetramethyldecane-5,8-diol | — | 0.40 | — | — | — |
| | pH Adjuster | 2-Amino-2-ethyl-1,3-propanediol | 0.20 | 0.10 | 0.10 | 0.20 | 0.20 |
| | Water | Pure water | Residual Amount | Residual Amount | Residual Amount | Residual Amount | Residual Amount |
| | | Total (% by mass) | 100 | 100 | 100 | 100 | 100 |

TABLE 2

| | | Components (% by mass) | Ink No. 6 | 7 | 8 | 9 | 10 |
|---|---|---|---|---|---|---|---|
| Water-dispersible colorants (Pigment dispersions) | | Surface-modified black pigment dispersion 1 (Preparation Example 1) | — | — | — | — | — |
| | | Surface-modified black pigment dispersion 2 (Preparation Example 2) | — | — | — | — | — |
| | | Surface-modified black pigment dispersion 3 (Preparation Example 3) | — | — | — | — | — |
| | | Surface-modified magenta pigment dispersion 1 (Preparation Example 4) | — | — | — | — | — |
| | | Surface-modified cyan pigment dispersion 1 (Preparation Example 5) | 22.50 | 22.50 | 22.50 | 22.50 | 22.50 |
| | | Surface-modified yellow pigment dispersion 1 (Preparation Example 6) | — | — | — | — | — |
| Water-dispersible resin | | Acrylic-silicone polymer particle dispersion | 5.00 | 5.00 | 5.00 | 5.00 | 5.00 |
| Wax | | AQ515: Polyethylene wax | — | 0.15 | 1.00 | 1.80 | — |
| Organic Solvents | Organic Solvents | Formula (1): 3-n-Butoxy-N,N-dimethylpropanamide (SP = 9.03) | 39.00 | 39.00 | 39.00 | 39.00 | — |
| | | Formula (4): 3-Ethyl-3-hydroxymethyloxetane (SP = 11.3) | — | — | — | — | 49.00 |
| | | 1,2-Butanediol (SP = 12.8) | — | — | — | — | — |
| | | 1,2-Propanediol (SP = 13.5) | 10.00 | 10.00 | 10.00 | 10.00 | — |
| | Penetrant | 2-Ethyl-1,3-hexanediol (SP = 10.6) | 2.00 | 2.00 | 2.00 | 2.00 | 2.00 |
| | | 2,2,4-Trimethyl-1,3-pentanediol (SP = 10.8) | — | — | — | — | — |
| Surfactants | | Formula (VII'): Polyether-modified siloxane compound | — | — | — | — | — |
| | | Formula (IX): Polyether-modified siloxane compound | — | — | — | — | 2.00 |
| | | Formula (X): Polyether-modified siloxane compound | — | — | — | — | — |
| | | TEGO Wet 270 | — | — | — | — | — |
| | | SILFACE SAG503A | 2.00 | 2.00 | 2.00 | 2.00 | — |
| | | SURFYNOL 104E | — | — | — | — | 2.00 |
| | | SOFTANOL EP-7025 | — | — | — | — | — |
| Fungicide | | PROXEL GXL | 0.05 | 0.05 | 0.05 | 0.05 | 0.05 |
| Foam inhibitor (Defoamer) | | 2,4,7,9-Tetramethyldecane-4,7-diol | 0.40 | 0.40 | 0.40 | 0.40 | 0.40 |
| | | 2,5,8,11-Tetramethyldecane-5,8-diol | — | — | — | — | — |
| pH Adjuster | | 2-Amino-2-ethyl-1,3-propanediol | 0.20 | 0.20 | 0.20 | 0.20 | 0.20 |
| Water | | Pure water | Residual Amount | Residual Amount | Residual Amount | Residual Amount | Residual Amount |
| | | Total (% by mass) | 100 | 100 | 100 | 100 | 100 |

TABLE 3

| | | Components (% by mass) | Ink No. 11 | 12 |
|---|---|---|---|---|
| Water-dispersible colorants (Pigment dispersions) | | Surface-modified black pigment dispersion 1 (Preparation Example 1) | — | — |
| | | Surface-modified black pigment dispersion 2 (Preparation Example 2) | — | — |
| | | Surface-modified black pigment dispersion 3 (Preparation Example 3) | — | — |
| | | Surface-modified magenta pigment dispersion 1 (Preparation Example 4) | — | — |
| | | Surface-modified cyan pigment dispersion 1 (Preparation Example 5) | 22.50 | 22.50 |
| | | Surface-modified yellow pigment dispersion 1 (Preparation Example 6) | — | — |
| Water-dispersible resin | | Acrylic-silicone polymer particle dispersion | 5.00 | 5.00 |
| Wax | | AQ515: Polyethylene wax | — | — |
| Organic Solvents | Organic solvents | Formula (1): 3-n-Butoxy-N,N-dimethylpropanamide (SP = 9.03) | — | — |
| | | Formula (4): 3-Ethyl-3-hydroxymethyloxetane (SP = 11.3) | 49.00 | 49.00 |
| | | 1,2-Butanediol (SP = 12.8) | — | — |
| | | 1,2-Propanediol (SP = 13.5) | — | — |

TABLE 3-continued

| | Components (% by mass) | Ink No. 11 | Ink No. 12 |
|---|---|---|---|
| Penetrant | 2-Ethyl-1,3-hexanediol (SP = 10.6) | 2.00 | 2.00 |
| | 2,2,4-Trimethyl-1,3-pentanediol (SP = 10.8) | — | — |
| Surfactants | Formula (VII'): Polyether-modified siloxane compound | — | — |
| | Formula (IX): Polyether-modified siloxane compound | 2.00 | 2.00 |
| | Formula (X): Polyether-modified siloxane compound | — | — |
| | TEGO Wet 270 | — | — |
| | SILFACE SAG503A | — | — |
| | UNIDYNE DSN403N | — | 2.00 |
| | SURFYNOL 104E | — | — |
| | SOFTANOL EP-7025 | 2.00 | — |
| Fungicide | PROXEL GXL | 0.05 | 0.05 |
| Foam inhibitor (Defoamer) | 2,4,7,9-Tetramethyldecane-4,7-diol | 0.40 | 0.40 |
| | 2,5,8,11-Tetramethyldecane-5,8-diol | — | — |
| pH Adjuster | 2-Amino-2-ethyl-1,3-propanediol | 0.20 | 0.20 |
| Water | Pure water | Residual Amount | Residual Amount |
| | Total (% by mass) | 100 | 100 |

Abbreviations etc. in Tables 1 to 3 refer to the following materials.

Wax: Polyethylene wax AQ515 available from BYK Japan KK

Organic solvent having Formula (1) SP=9.03

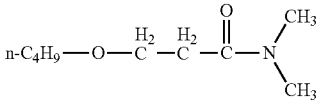

Organic solvent having Formula (4) SP=11.3

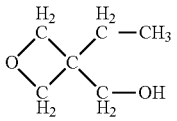

Polyether-modified siloxane compound having Formula (VII')

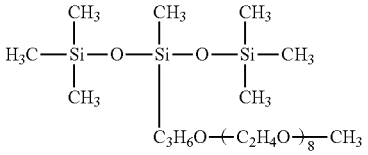

Polyether-modified siloxane compound having Formula (IX)

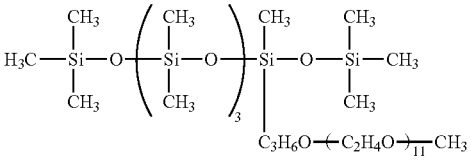

Polyether-modified siloxane compound having Formula (X)

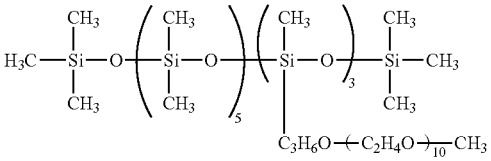

TEGO Wet 270: Polyether-modified siloxane compound (available from Evonik Japan Co., Ltd., containing 100% by mass of active ingredients)

SILFACE SAG503A: Polyether-modified siloxane compound (available from Nissin Chemical Industry Co., Ltd., containing 100% by mass of active ingredients)

UNIDYNE DSN403N: Polyoxyethylene perfluoroalkyl ether (available from Daikin Industries, Ltd., containing 100% by mass of active ingredients)

SURFYNOL 104E: Acetylene glycol compound (available from Nissin Chemical Industry Co., Ltd., containing 100% by mass of active ingredients)

SOFTANOL EP-7025: Higher alcohol ethoxylate (available from NIPPON SHOKUBAI CO., LTD., containing 100% by mass of active ingredients)

PROXEL GXL: Fungicide consisting mainly of 1,2-benzisothiazolin-3-one (available from AVECIA GROUP, containing 20% by mass of active ingredients and dipropylene glycol)

Properties of the above-prepared Inks 1 to 12 were measured as follows. Results are shown in Table 4.

Viscosity

Viscosity of each ink was measured with a viscometer (RE-550L available from Toki Sangyo Co., Ltd.) at 25° C.

pH pH of each ink was measured with a pH meter (HM-30R available from DKK-TOA Corporation) at 25° C.

Dynamic Surface Tension

Dynamic surface tension of each ink was measured by a maximum bubble pressure method when a bubble lifetime is 15 msec, using an instrument SITA DynoTester (available from SITA Messtechnik GmbH) at 25° C.

Static Surface Tension

Static surface tension of each ink was measured with an automatic surface tensiometer (DY-300 available from Kyowa Interface Science Co., Ltd.) at 25° C.

TABLE 4

| | Ink Properties | | | | |
|---|---|---|---|---|---|
| Ink No. | Viscosity (mPa · s) | pH | 15 msec Dynamic surface tension A (mN/m) | Static surface tension B (mN/m) | [(A − B)/(A + B)] × 100 |
| Ink 1 | 8.2 | 9.5 | 33.2 | 24.3 | 15.5% |
| Ink 2 | 8.4 | 9.7 | 29.7 | 22.1 | 14.7% |
| Ink 3 | 8.0 | 9.4 | 33.3 | 26.8 | 10.8% |
| Ink 4 | 8.5 | 9.7 | 32.3 | 22.6 | 17.7% |
| Ink 5 | 7.8 | 9.2 | 27.5 | 20.8 | 13.9% |
| Ink 6 | 7.9 | 9.5 | 32.4 | 26.1 | 10.8% |
| Ink 7 | 9.3 | 9.6 | 32.3 | 23.3 | 16.2% |
| Ink 8 | 8.3 | 9.5 | 30.1 | 22.5 | 14.5% |
| Ink 9 | 9.6 | 9.4 | 32.9 | 23.2 | 17.3% |
| Ink 10 | 8.1 | 9.4 | 34.8 | 29.5 | 8.2% |
| Ink 11 | 8.2 | 9.4 | 37.9 | 30.6 | 10.7% |
| Ink 12 | 8.4 | 9.0 | 28.8 | 19.5 | 19.3% |

Examples 1 to 12 and Comparative Examples 1 to 6

Image Formation

Under an environmental condition adjusted at 23±0.5° C., 50±5% RH, an image forming apparatus equipped with the circulation-type head illustrated in FIGS. 3 to 11 (i.e., a modified IPSiO GX-e5500 available from Ricoh Co., Ltd.) was set up such that the drive voltage of the piezo element was fluctuated to make the ink discharge amount constant, specifically, to make the ink deposition amount on a recording medium OK TOP COAT+(available from Oji Paper Co., Ltd., having a basis weight of 104.7 g/m$^2$) constant.

As shown in Table 5, in each of Examples 1 to 12 and Comparative Examples 1 to 6, the liquid feed amount of the liquid feed pump was adjusted such that the flow rate of the circulated ink became a multiple of the maximum dischargeable rate of the ink discharge head. The flow rate of the ink was measured by a flowmeter. Here, the maximum dischargeable rate is the specification value of the ink discharge head.

In Examples 1 to 12 and Comparative Examples 1 to 6, various properties were evaluated as follows. Results are shown in Table 5.

Image Density

A chart including a 64-point symbol "black square" (■), formed with Microsoft Word 2000, was printed on a recording medium MY PAPER (available from Ricoh Co., Ltd.) by an image forming apparatus equipped with the circulation-type head illustrated in FIGS. 3 to 11 (i.e., a modified IPSiO GX-e5500 available from Ricoh Co., Ltd.). The image density of the "black square" printed on the recording medium was measured by a spectrodensitometer (X-Rite 939 available from X-Rite) and evaluated based on the following criteria. As the printing mode, the "Plain paper—Standard/Fast" mode was used, having modified not to perform color correction, through the user setting for plain paper by a driver attached to the printer.

Evaluation Criteria

A: Black ID=1.25 or more, Yellow ID=0.8 or more, Magenta ID=1.00 or more, Cyan ID=1.05 or more B: Black ID=not less than 1.20 and less than 1.25, Yellow ID=not less than 0.75 and less than 0.8, Magenta ID=not less than 0.95 and less than 1.00, Cyan ID=not less than 1.00 and less than 1.05

C: Black ID=not less than 1.15 and less than 1.20, Yellow ID=not less than 0.70 and less than 0.75, Magenta ID=not less than 0.90 and less than 0.95, Cyan ID=not less than 0.95 and less than 1.00

D: Black ID=less than 1.15, Yellow ID=less than 0.70, Magenta ID=less than 0.90, Cyan ID=less than 0.95

Beading Resistance

A solid image was printed on a recording medium OK TOP COAT+ (available from Oji Paper Co., Ltd., having a basis weight of 104.7 g/m$^2$) by the image forming apparatus equipped with the circulation-type head illustrated in FIGS. 3 to 11 (i.e., a modified IPSiO GX-e5500 available from Ricoh Co., Ltd.). As the printing mode, the "Gloss paper—Beautiful" mode was used, having modified not to perform color correction, by a driver attached to the printer. The printed solid images were visually observed to determine whether beading (image unevenness) had occurred or not. Beading resistance was evaluated based on the following criteria.

Evaluation Criteria

A: No beading occurred.

B: Beading occurred slightly.

C: Beading occurred considerably.

D: Beading occurred severely.

The black solid image was observed with an optical microscope at a magnification of 40 times because of being very hard to observe with naked eyes.

Rub Resistance

A solid image (ink film) having a resolution of 1,200 dpi×1,200 dpi was recorded on a paper (Lumi Art Gloss 130gsm available from Stora Enso) at an ink deposition amount of 1.12 mg/cm$^2$ (i.e., 700 mg/A4 size) by the image forming apparatus equipped with the circulation-type head illustrated in FIGS. 3 to 11 (i.e., a modified IPSiO GX-e5500 available from Ricoh Co., Ltd.).

After being dried at 100° C. for 1 minute, each solid image was rubbed with a 1.2-cm-square piece of paper (Lumi Art Gloss 130gsm available from Stora Enso) with a load of 400 g for 20 times. The degree of ink deposition on the piece of paper was determined from the difference in color density before and after the rubbing of the solid image. The color density was measured with a reflective spectrophotometric color densitometer (available from X-Rite). Rub resistance was evaluated based on the following criteria. The ranks A, B, and C are acceptable.

Evaluation Criteria

A: The difference in color density was less than 0.05.

B: The difference in color density was 0.05 or more and less than 0.10.

C: The difference in color density was 0.10 or more and less than 0.20.

D: The difference in color density was 0.20 or more.

Discharge Stability

A print chart having a print area ratio of 5% was printed on 1,000 sheets by the image forming apparatus equipped with the circulation-type head illustrated in FIGS. 3 to 11 (i.e., a modified IPSiO GX-e5500 available from Ricoh Co., Ltd.). Immediately after the 1,000$^{th}$ sheet was printed out and after a lapse of 24 hours from the end of the printing, a solid image, a halftone image, and a nozzle check pattern were each printed on 5 sheets of an industrial inkjet paper (SWORD iJET 4.3 Gloss available from Mitsubishi Paper Mills Limited). The printed images were visually observed to determine image uniformity and the presence of nozzle-like voids, to evaluate the degrees of irregular discharge or nozzle clogging.

The printing operation was one pass printing performed under the condition "100% duty" with a recording density of 600×300 dpi. The evaluation criteria are as follows. During the evaluation, the ink was always circulated regardless of whether the circulation-type discharge head was in operation or not.

Evaluation Criteria

A: Neither irregular discharge nor nozzle clogging occurred.

B: Irregular discharge slightly occurred, but no nozzle clogging occurred.

C: Irregular discharge considerably occurred, and nozzle clogging occurred.

Meniscus Outflow

The image forming apparatus equipped with the circulation-type head illustrated in FIGS. 3 to 11 (i.e., a modified IPSiO GX-e5500 available from Ricoh Co., Ltd.) was let to circulate a specified amount (i.e., 1.0 time the maximum dischargeable rate) of each ink for 10 minutes while suspending discharge operation. The condition of meniscus outflow at the nozzle surface was thereafter observed with a stroboscopic instrument equipped with a CCD camera to observe the discharge condition of the nozzle. Further, the condition of the discharged ink droplets was observed. Evaluation was made based on the following criteria.

Evaluation Criteria

A: No meniscus outflow observed. Normal discharge condition.

B: Slight degree of meniscus outflow observed. Normal discharge condition.

C: Considerable degree of meniscus outflow observed. Curved discharge occurred.

TABLE 5

| | Ink No. | Flow rate (times) | Image density | Beading resistance | Rub resistance | Discharge stability | Meniscus outflow |
|---|---|---|---|---|---|---|---|
| Example 1 | 1 | 0.20 | B | B | C | B | A |
| Example 2 | 1 | 0.80 | B | B | C | A | A |
| Example 3 | 1 | 1.20 | B | B | C | A | A |
| Example 4 | 1 | 1.50 | B | B | C | B | B |
| Example 5 | 2 | 0.80 | A | A | B | A | A |
| Example 6 | 3 | 0.80 | B | B | B | A | A |
| Example 7 | 4 | 0.80 | A | A | B | B | A |
| Example 8 | 5 | 0.80 | A | A | B | A | A |
| Example 9 | 6 | 0.80 | A | A | B | A | A |
| Example 10 | 7 | 0.80 | A | A | B | A | A |
| Example 11 | 8 | 0.80 | A | A | A | A | A |
| Example 12 | 9 | 0.80 | A | A | A | A | A |
| Comparative Example 1 | 1 | 0.08 | B | B | C | C | A |
| Comparative Example 2 | 1 | 1.60 | B | B | C | B | C |
| Comparative Example 3 | 10 | 0.80 | B | D | C | C | B |
| Comparative Example 4 | 11 | 0.80 | C | D | C | B | C |
| Comparative Example 5 | 1 | 0.00 | B | B | C | C | C |
| Comparative Example 6 | 12 | 0.80 | B | D | C | B | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An ink discharge device comprising:

an ink comprising:

a colorant;

an organic solvent; and water;

an ink discharge head including:

a nozzle configured to discharge the ink;

an individual liquid chamber communicated with the nozzle;

a flow-in channel configured to let the ink flow into the individual liquid chamber; and a flow-out channel configured to let the ink flow out from the individual liquid chamber; and a circulator configured to circulate the ink by letting the ink flow into the individual liquid chamber via the flow-in channel and flow out from the individual liquid chamber via the flow-out channel, wherein a flow rate of the circulated ink is 0.10 to 1.50 times a maximum dischargeable rate of the ink discharge head, wherein a dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation:

$$10.0(\%) \leq [(A-B)/(A+B)] \times 100 \leq 19.0(\%).$$

2. The ink discharge device of claim 1, wherein the flow rate of the circulated ink is 0.20 to 1.20 times the maximum dischargeable rate of the ink discharge head.

3. The ink discharge device of claim 1, wherein the dynamic surface tension A of the ink at 25° C. is 30.0 mN/m or less when measured by the maximum bubble pressure method at a surface lifetime of 15 msec, and the dynamic surface tension A and the static surface tension B of the ink at 25° C. satisfy the following relation:

$$12.0(\%) \leq [(A-B)/(A+B)] \times 100 \leq 17.0(\%).$$

4. The ink discharge device of claim 1, wherein the static surface tension B of the ink at 25° C. is from 20.0 to 30.0 mN/m.

5. The ink discharge device of claim 1, wherein the organic solvent has a solubility parameter not less than 8.96 and less than 11.8.

6. The ink discharge device of claim 1, wherein the colorant comprises a water-dispersible pigment having a hydrophilic functional group on a surface thereof, the hydrophilic functional group comprising a quaternary ammonium salt.

7. The ink discharge device of claim 1, wherein the ink further comprises a polyethylene wax, and solid contents of the polyethylene wax account for 0.1% to 2.0% by mass of the ink.

8. The ink discharge device of claim 1, wherein the ink further comprises a surfactant comprising a polyether-modified siloxane compound.

9. The ink discharge device of claim 1, further comprising:

an ink storage container storing the ink;

an ink supplier configured to supply the ink to the individual liquid chamber via the flow-in channel; and inward and outward liquid feed channels configured to circulate the ink between the ink storage container and the ink supplier.

10. An ink discharge method comprising:

discharging an ink from a nozzle disposed in an ink discharge head, including:

letting an ink flow into an individual liquid chamber via a flow-in channel, the individual liquid chamber communicated with the nozzle;

letting the ink flow out from the individual liquid chamber via a flow-out channel; and circulating the ink by letting the ink flow into the individual liquid chamber via the flow-in channel and flow out from the individual liquid chamber via the flow-out channel;

wherein the ink comprises a colorant, an organic solvent, and water, wherein a flow rate of the circulated ink is 0.10 to 1.50 times a maximum dischargeable rate of the ink discharge head, wherein a dynamic surface tension A of the ink at 25° C. is 34.0 mN/m or less when measured by a maximum bubble pressure method at a surface lifetime of 15 msec, and the dynamic surface tension A and a static surface tension B of the ink at 25° C. satisfy the following relation:

$$10.0(\%) \leq [(A-B)/(A+B)] \times 100 \leq 19.0(\%).$$

* * * * *